US012674102B2

(12) United States Patent
Zellhuber et al.

(10) Patent No.: US 12,674,102 B2
(45) Date of Patent: Jul. 7, 2026

(54) METHOD AND SYSTEM FOR STEAMCRACKING

(71) Applicant: LINDE GMBH, Pullach (DE)

(72) Inventors: Mathieu Zellhuber, Martinsried (DE); Michael Horenz, Munich (DE); David Bruder, Munich (DE); Martin Hofstatter, Munich (DE)

(73) Assignee: LINDE GMBH, Pullach (DE)

( * ) Notice: Subject to any disclaimer, the term of this patent is extended or adjusted under 35 U.S.C. 154(b) by 50 days.

(21) Appl. No.: 18/548,888

(22) PCT Filed: Mar. 8, 2022

(86) PCT No.: PCT/EP2022/055878
§ 371 (c)(1),
(2) Date: Sep. 1, 2023

(87) PCT Pub. No.: WO2022/189424
PCT Pub. Date: Sep. 15, 2022

(65) Prior Publication Data

US 2024/0158700 A1 May 16, 2024

(30) Foreign Application Priority Data

Mar. 10, 2021 (EP) ..... 21161780

(51) Int. Cl.
*C10G 9/24* (2006.01)
*C10G 9/00* (2006.01)
(Continued)

(52) U.S. Cl.
CPC ..... *C10G 9/24* (2013.01); *C10G 9/002* (2013.01); *C10G 9/36* (2013.01); *F01K 13/02* (2013.01)

(58) Field of Classification Search
None
See application file for complete search history.

(56) References Cited

U.S. PATENT DOCUMENTS 3,426,733 A 2/1969 Von Wiesenthal
4,107,226 A 8/1978 Ennis, Jr. et al.
(Continued)

FOREIGN PATENT DOCUMENTS

CN 1358222 A 7/2002
CN 106164222 A 11/2016
(Continued)

OTHER PUBLICATIONS

International Search Report and Written Opinion issued in related App. No. PCT/EP2022/055878, mailed Jun. 13, 2022.
(Continued)

*Primary Examiner* — In Suk C Bullock
*Assistant Examiner* — Alyssa L Cepluch
(74) *Attorney, Agent, or Firm* — Avek IP, LLC

(57) ABSTRACT

A method of steam cracking using a steam cracking arrangement including an electric cracking furnace without a convection zone and a quench cooling train is proposed, wherein a process gas stream is passed through the cracking furnace and the cooling train. The cooling train is operated to comprise at least two distinct cooling steps arranged in either order, wherein in a first cooling step at least a part of the process gas stream withdrawn from the electric cracking furnace is cooled against vaporizing boiler feed water at an absolute pressure level between 30 and 175 bar and wherein in a second cooling step at least a part of the process gas stream withdrawn from the electric cracking furnace is cooled against a superheated mixture of feed hydrocarbons and process steam used in forming the process gas stream which is thereby heated to a temperature level between 350 and 750° C.

19 Claims, 11 Drawing Sheets

(51) Int. Cl.
*C10G 9/36* (2006.01)
*F01K 13/02* (2006.01)

(56) References Cited

U.S. PATENT DOCUMENTS

| | | | | |
|---|---|---|---|---|
| 4,321,130 | A | 3/1982 | Bacsik | |
| 4,617,109 | A | 10/1986 | Wells et al. | |
| 4,912,282 | A * | 3/1990 | Klaus | C10G 9/14 585/650 |
| 9,989,305 | B2 * | 6/2018 | Mak | F25J 3/0242 |
| 2003/0175642 | A1 | 9/2003 | Stephens et al. | |
| 2006/0116543 | A1 | 6/2006 | Bellet et al. | |
| 2014/0212823 | A1 | 7/2014 | Novak et al. | |
| 2016/0097002 | A1 | 4/2016 | Sundaram | |
| 2017/0022429 | A1 | 1/2017 | Van Willigenburg | |
| 2020/0172814 | A1 | 6/2020 | Oud | |
| 2020/0290939 | A1 | 9/2020 | Willigenburg | |
| 2021/0171836 | A1 | 6/2021 | Purola | |
| 2022/0395805 | A1 | 12/2022 | Mortensen | |
| 2023/0407186 | A1 * | 12/2023 | Sundaram | C10G 9/24 |
| 2024/0158700 | A1 | 5/2024 | Zellhuber et al. | |
| 2024/0158701 | A1 | 5/2024 | Horenz et al. | |
| 2024/0158702 | A1 | 5/2024 | Zellhuber et al. | |
| 2024/0239728 | A1 | 7/2024 | Keller et al. | |
| 2025/0026986 | A1 | 1/2025 | Zellhuber et al. | |

FOREIGN PATENT DOCUMENTS

| | | | |
|---|---|---|---|
| CN | 109844068 | A | 6/2019 |
| CN | 111944556 | A | 11/2020 |
| CN | 112368235 | A | 2/2021 |
| DE | 710185 | C | 9/1941 |
| DE | 1615278 | A1 | 7/1970 |
| DE | 2362628 | A1 | 6/1975 |
| DE | 3334334 | A1 | 4/1985 |
| DE | 4128180 | A1 | 2/1993 |
| DE | 102004020223 | A1 | 11/2005 |
| EP | 0229939 | A1 | 7/1987 |
| EP | 0229939 | B1 | 7/1987 |
| EP | 3075704 | A1 | 10/2016 |
| EP | 3249027 | A1 | 11/2017 |
| EP | 3249028 | A1 | 11/2017 |
| EP | 3415587 | A1 | 12/2018 |
| EP | 3730592 | A1 | 10/2020 |
| EP | 3748138 | A1 | 12/2020 |
| WO | 2005113713 | A2 | 12/2005 |
| WO | 2013178446 | A1 | 12/2013 |
| WO | 2014090914 | A1 | 6/2014 |
| WO | 2015197181 | A1 | 12/2015 |
| WO | 2018020399 | A1 | 2/2018 |
| WO | 2018065919 | A1 | 4/2018 |
| WO | 2018229267 | A1 | 12/2018 |
| WO | 2020035575 | A1 | 2/2020 |
| WO | 2020150244 | A1 | 7/2020 |
| WO | 2020150248 | A1 | 7/2020 |
| WO | 2020150249 | A1 | 7/2020 |
| WO | 2021052642 | A1 | 3/2021 |
| WO | 2022189423 | A1 | 9/2022 |

OTHER PUBLICATIONS

Office Action and Search Report issued Oct. 21, 2025 in Chinese Application No. 202280034298.0, 6 pages.

Sinatra et al., "Polimeri Europa Olefin Plant Maximizes Benefits from Advanced Solutions," 2003 AIChE Spring National Meeting, Apr. 2, 2003, pp. 1-29.

Office Action issued Mar. 27, 2026 in Chinese patent application No. 202280020029.9.

* cited by examiner

METHOD AND SYSTEM FOR STEAMCRACKING

CROSS-REFERENCE TO RELATED APPLICATIONS

This application is the national phase of, and claims priority to, International Application No. PCT/EP2022/055878, filed Mar. 8, 2022, which claims priority to European Application No. EP 21161780.8, filed Mar. 10, 2021.

FIELD OF THE INVENTION

The invention relates to a method and a system for steam cracking.

BACKGROUND

The invention is based on the steam cracking technology for the production of olefins and other base chemicals, as e.g. described in the article "Ethylene" in Ullmann's Encyclopedia of Industrial Chemistry, online publication 15 Apr. 2009, DOI: 10.1002/14356007.a10_045.pub2.

A method and apparatus for steam cracking hydrocarbons is disclosed in US 2006/116543 A1. This method consists in heating a mixture of hydrocarbons and steam to a desired temperature that is high enough to crack the hydrocarbons and transform them into olefins, the method being characterized in that the source of energy needed for heating the mixture is supplied essentially by cogeneration using combustion of a fuel to produce simultaneously both heat energy and mechanical work which is transformed into electricity by an alternator, and in that the mixture is initially subjected to preheating using the heat energy supplied by the cogeneration, and is subsequently heated to the desired cracking temperature by means of electrical heating using the electricity supplied by the cogeneration.

In US 2020/172814 A1, a cracking furnace system for converting a hydrocarbon feedstock into cracked gas comprising a convection section, a radiant section and a cooling section, wherein the convection section includes a plurality of convection banks configured to receive and preheat hydrocarbon feedstock, wherein the radiant section includes a firebox comprising at least one radiant coil configured to heat up the feedstock to a temperature allowing a pyrolysis reaction, wherein the cooling section includes at least one transfer line exchanger.

Presently, the thermal energy required for initiating and maintaining the endothermic cracking reactions in steam cracking is provided by the combustion of fuel gas in a refractory furnace. The process gas initially containing steam and the hydrocarbons to be cracked is passed through so-called cracking coils placed inside the refractory box, also called radiant zone or section. On this flow path the process gas is continuously heated, enabling the desired cracking reactions to take place inside the cracking coils, and thus the process gas is continuously enriched in the cracking products. Typical inlet temperatures for the process gas into the cracking coils are between 550 and 750° C., outlet temperatures are typically in the range between 800 and 900° C.

In addition to the radiant zone, fired cracking furnaces comprise a so-called convection zone or section and a so-called quench zone or section. The convection zone is usually positioned above the radiant zone and composed of various tube bundles traversing the flue gas duct from the radiant zone. Its main function is to recover as much energy as possible from the hot flue gas leaving the radiant zone. Indeed, only 35 to 50% of the total firing duty is typically transferred within the radiant zone to the process gas passed through the cracking coils. The convection zone therefore plays a central role in the energy management in steam cracking, as it is responsible for the beneficial usage of approximately 40 to 60% of the heat input into a furnace (i.e. of the firing duty). Indeed, when taking the radiant and convection zone together, modern steam cracking plants make use of 90 to 95% of the overall fired duty (based on the fuel's lower heating value or net calorific value). In the convection section, the flue gas is cooled down to temperature levels between 60 and 140° C. before leaving the convection section and being released to the atmosphere via stack.

The flue gas heat recovered in the convection zone is typically used for process duties such as preheating of boiler feed water and/or hydrocarbon feeds, (partial) vaporization of liquid hydrocarbon feeds (with or without prior process steam injection), and superheating of process steam and high-pressure steam.

The quench zone is positioned downstream of the radiant zone along the main process gas route. It is composed of one or more heat exchanger units, having the main functions of quickly cooling the process gas below a maximum temperature level to stop the cracking reactions, to further cool down the process gas for downstream treatment, and to effectively recover sensible heat from the process gas for further energetic usage. In addition, further cooling or quenching can be effected via injection of liquids, e.g. by oil quench cooling when steam cracking liquid feeds.

The process gas heat recovered in the quench section is typically used for vaporizing high-pressure (HP) or super-high-pressure (SHP) boiler feed water (typical at a pressure range between 30 and 130 bar absolute pressure), and for preheating the same boiler feed water, before it being fed to a steam drum. Saturated high-pressure or super-high-pressure steam generated accordingly may be superheated in the convection zone (see above) to form superheated high-pressure or super-high-pressure steam, and from there may be distributed to the central steam system of the plant, providing heat and power for heat exchangers and steam turbines or other rotating equipment. The typical degree of steam superheating achieved in furnace convection zones lies between 150 and 250 K above the saturation temperature (dew point margin). Generally, steam cracking furnaces may operate with high-pressure steam (typically at 30 to 60 bar) or with super-high-pressure-steam (typically at 60 to 130 bar). For the sake of clarity in the description of the invention, high-pressure-steam will be used for the entire pressure range between 30 and 130 bar, but also beyond this upper limit, since the invention includes usage of steam at pressures of up to 175 bar.

An important part of the process gas treatment subsequent to quench cooling is compression which is typically performed after further treatment such as the removal of heavy hydrocarbons and process water, in order to condition the process gas for separation. This compression, also called process or cracked gas compression, is typically performed with multistage compressors driven by steam turbines. In the steam turbines, steam at a suitable pressure from the central steam system of the plant mentioned, and thus comprising steam produced using heat from the convection section and from quench cooling, can be used. Typically, in a steam cracking plant of the prior art, heat of the flue gas (in the convection zone) and heat of the process gas (in the quench zone) is well balanced with the heat demand for producing a large part of the steam amounts needed for heating and driving steam turbines. In other words, waste heat may be more or less fully utilized for generating steam which is needed in the plant. Additional heat for steam generation may be provided in a (fired) steam boiler.

For reference, and to further illustrate the background of the invention, a conventional fired steam cracking arrangement is illustrated in FIG. 1 in a highly simplified, schematic partial representation and is designated 900.

The steam cracking arrangement 900 illustrated in FIG. 1 comprises, as illustrated with a reinforced line, one or more cracking furnaces 90. For conciseness only, "one" cracking furnace 90 is referred to in the following, while typical steam cracking arrangements 900 may comprise a plurality of cracking furnaces 90 which can be operated under the same or different conditions. Furthermore, cracking furnaces 90 may comprise one or more of the components explained below.

The cracking furnace 90 comprises a radiant zone 91 and a convection zone 92. In other embodiments than the one shown in FIG. 1, also several radiant zones 91 may be associated with a single convection zone 92, etc.

In the example illustrated, several heat exchangers 921 to 925 are arranged in the convection zone 92, either in the arrangement or sequence shown or in a different arrangement or sequence. These heat exchangers 921 to 925 are typically provided in the form of tube bundles passing through the convection zone 92 and are positioned in the flue gas stream from the radiant zone 91.

In the example illustrated, the radiant zone 91 is heated by means of a plurality of burners 911 arranged on the floor and wall sides of a refractory forming the radiant zone 91, which are only partially designated. In other embodiments, the burners 911 may also be provided solely at the wall sides or solely at the floor side. The latter may preferentially be the case e.g. when pure hydrogen is used for firing.

In the example illustrated, a gaseous or liquid feed stream 901 containing hydrocarbons is provided to the steam cracking arrangement 900. It is also possible to use several feed streams 901 in the manner shown or in a different manner. The feed stream 901 is preheated in the heat exchanger 921 in the convection zone 92.

In addition, a boiler feed water stream 902 is passed through the convection zone 92 or, more precisely, the heat exchanger 922, where it is preheated. The boiler feed water stream 902 is thereafter introduced into a steam drum 93. In the heat exchanger 923 in the convection zone 92, a process steam stream 903, which is typically provided from a process steam generation system located outside the furnace system of the steam cracking arrangement 900, is further heated and, in the example illustrated in FIG. 1, thereafter combined with the feed stream 901.

A stream 904 of feed and steam formed accordingly is passed through a further heat exchanger 925 in the convection zone 92 and is thereafter passed through the radiant zone 91 in typically several cracking coils 912 to form a cracked gas stream 905. The illustration in FIG. 1 is highly simplified. Typically, a corresponding stream 904 is evenly distributed over a number of cracking coils 912 and a cracked gas formed therein is collected to form the cracked gas stream 905.

As further illustrated in FIG. 1, a steam stream 906 can be withdrawn from the steam drum 93 and can be (over)heated in a further heat exchanger 924 in the convection zone 92, generating a high-pressure steam stream 907. The high-pressure steam stream 907 can be used in the steam cracking arrangement 900 at any suitable location and for any suitable purpose as not specifically illustrated.

The cracked gas stream 905 from the radiant zone 12 or the cracking coils 912 is passed via one or more transfer lines to a quench exchanger 94 where it is rapidly cooled for the reasons mentioned. The quench exchanger 94 illustrated here represents a primary quench (heat) exchanger. In addition to such a primary quench exchanger 94, further quench exchangers may also be present.

The cooled cracked gas stream 915 is passed to further process units 95 which are shown here only very schematically. These further process units 95 can, in particular, be process units for scrubbing, compression and fractionation of the cracked gas, and a compressor arrangement including a steam turbine, which may be operated using steam from the steam drum 93.

In the example shown, the quench exchanger 94 is operated with a water stream 908 from the steam drum 93. A steam stream 909 formed in the quench exchanger 94 is returned to the steam drum 93.

SUMMARY

Ongoing efforts to reduce at least local carbon dioxide emissions of industrial processes also extend to the operation of steam cracking plants. As in all fields of technology, a reduction of local carbon dioxide emissions may particularly be effected by electrification of a part of or all possible process units.

As described in EP 3 075 704 A1 in connection with a reformer furnace, a voltage source may be used in addition to a burner, the voltage source being connected to the reactor tubes in such a manner that an electric current generated thereby heats the feedstock. Steam cracking plants in which electrically heated steam cracking furnaces are used were proposed for example in WO 2020/150244 A1, WO 2020/150248 A1 and WO 2020/150249 A1. Electric furnace technology in other or broader contexts is for example disclosed in WO 2020/035575 A1, WO 2015/197181 A1, EP 3 249 028 A1, EP 3 249 027 A1 and WO 2014/090914 A1, or in older documents such as for example DE 23 62 628 A1, DE 1 615 278 A1, DE 710 185 C and DE 33 34 334 A1.

US 2006/116543 A1 discloses a method and apparatus for steam cracking hydrocarbons, which method consists in heating a mixture of hydrocarbons and steam to a desired temperature that is high enough to crack the hydrocarbons and transform them into olefins, the method being characterized in that the source of energy needed for heating the mixture is supplied essentially by cogeneration using combustion of a fuel to produce simultaneously both heat energy and mechanical work which is transformed into electricity by an alternator, and in that the mixture is initially subjected to preheating using the heat energy supplied by the cogeneration, and is subsequently heated to the desired cracking temperature by means of electrical heating using the electricity supplied by the cogeneration.

According to US 2020/172814 A1, a cracking furnace system for converting a hydrocarbon feedstock into cracked gas comprises a convection section, a radiant section and a cooling section, wherein the convection section includes a plurality of convection banks configured to receive and preheat hydrocarbon feedstock, wherein the radiant section includes a firebox comprising at least one radiant coil configured to heat up the feedstock to a temperature allowing a pyrolysis reaction, wherein the cooling section includes at least one transfer line exchanger.

Completely or partly modifying the heating concept of a steam cracking plant, i.e. using heat generated by electric energy completely or partly instead of heat generated by burning a fuel, is a rather substantial intervention. As an alternative, less invasive redesign options are often desired, particularly when retrofitting existing plants. These may for example include substituting a steam turbine used for driving the process gas compressor or a different compressor at least partly by an electric drive. While, as mentioned, such a steam turbine may be partly operated with steam generated by waste heat recovered in the convection section of the cracking furnaces, fired steam boilers must typically be provided additionally to supply sufficient steam quantities. Therefore, substituting a steam turbine used for driving the compressors mentioned at least partly by an electric drive may be suitable to reduce or avoid fired boiler duty and thereby to reduce local carbon dioxide emissions.

As further explained below, however, particularly an electrification of parts of such plants has a significant influence on the heat balance of the overall plant. That is, if steam turbines for driving compressors are substituted by electric drives, the waste heat generated in the plant, which was previously used for driving the steam turbines, cannot be fully utilized anymore. On the other hand, if fired furnaces are substituted by electric furnaces, no waste heat from flue gases, which was previously used for providing steam, heating feeds, etc. is not available anymore.

In other words, substituting any carbon dioxide emitting parts of a steam cracking parts has a massive influence on the overall plant operation and is not simply a matter of exchanging one component against another. An efficient and effective integration of such components into a steam cracking plant is therefore of paramount importance for the overall plant design, in particular regarding energy management.

The invention relates, in this connection, particularly to a situation wherein fired steam cracking furnaces are substituted by electrically heated steam cracking furnaces, resulting in substantially less or no steam to be produced and to be available for steam consumers such as steam turbines or other rotating equipment. The invention particularly relates to a situation wherein a "full electrification" of a steam cracking plant is realized. In such situations, as mentioned, an adapted mode of operation must be found as the conventionally well-balanced steam production and consumption situation is changed almost completely.

According to one embodiment of the invention, a method of steam cracking includes providing a steam cracking arrangement that has an electric cracking furnace without a convection zone; and a quench cooling train. The method further includes passing a process gas stream at least through the electric cracking furnace and the quench cooling train. The quench cooling train is operated in at least two distinct cooling steps arranged in either order, wherein, in a first one of the cooling steps at least a part of the process gas stream withdrawn from the electric cracking furnace is cooled against vaporizing boiler feed water at an absolute pressure level between 30 and 175 bar; and in a second one of the cooling steps at least a part of the process gas stream withdrawn from the electric cracking furnace is cooled against a superheated mixture of feed hydrocarbons and process steam used in forming the process gas stream which is thereby heated to a temperature level between 350 and 750° C.

According to another embodiment of the invention, a system for performing a method of steam cracking includes a steam cracking arrangement, having an electric cracking furnace without a convection zone; and a quench cooling train. The system is configured to pass a process gas stream at least through the electric cracking furnace and the quench cooling train. The quench cooling train comprises means to perform at least two distinct cooling steps, wherein a first one of the cooling steps is adapted to cool at least a part of the process gas stream withdrawn from the electric cracking furnace against vaporizing boiler feed water at an absolute pressure level between 30 and 175 bar; and a second one of the cooling steps is adapted to cool at least a part of the process gas stream withdrawn from the electric cracking furnace against a superheated mixture of feed hydrocarbons and process steam used in forming the process gas stream which is thereby heated to a temperature level between 350 and 750° C.

DETAILED DESCRIPTION

Figure 1:
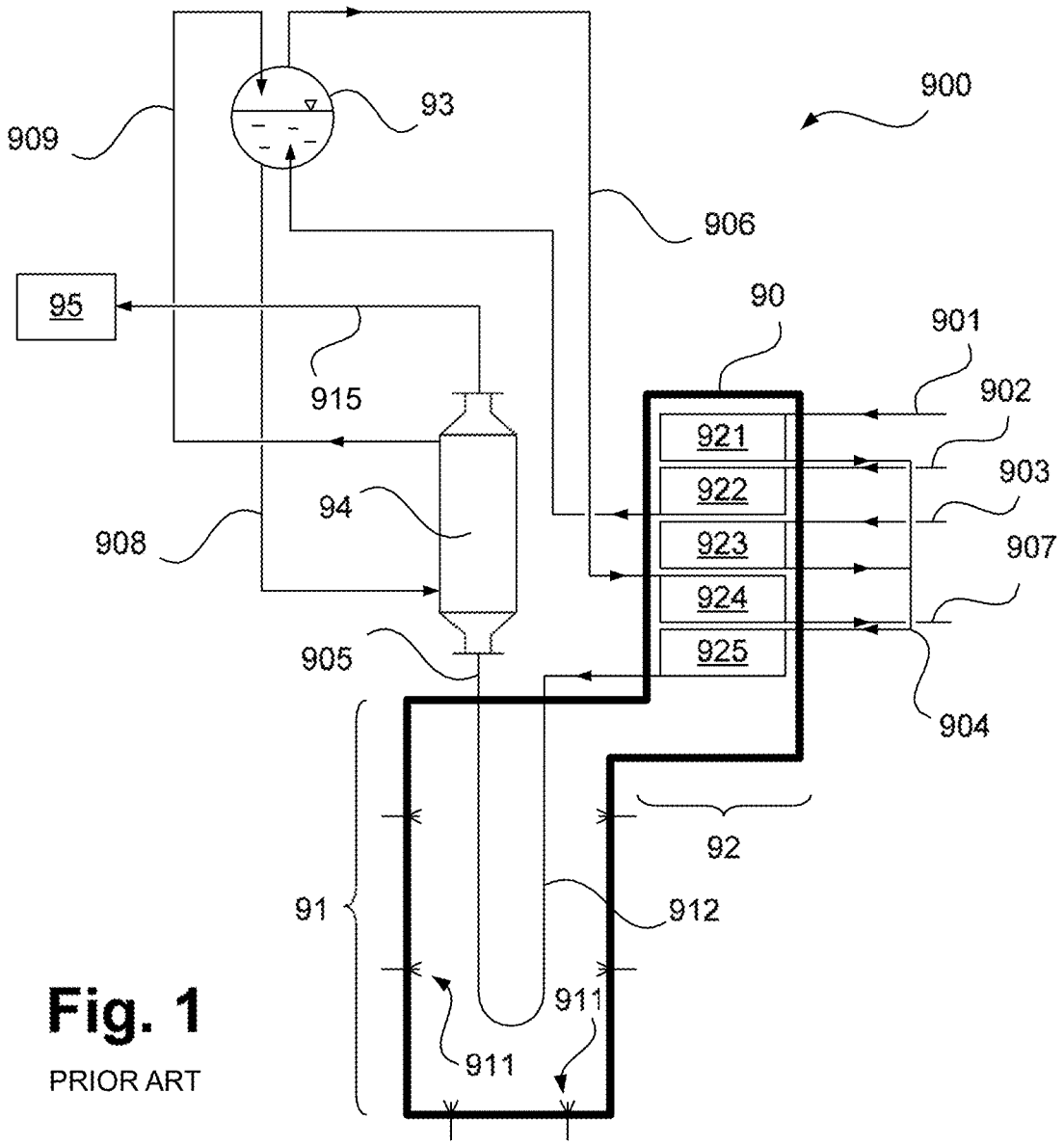
Fig. 1 PRIOR ART
FIG. 1 illustrates a prior art embodiment not forming part of the invention.

Before further describing the features and advantages of the invention, some terms used in the description thereof will be further explained.

The term "process steam" shall refer to steam that is added to a hydrocarbon feed before the hydrocarbon feed is subjected to steam cracking. In other terminology, the process steam is a part of a corresponding feed. Process steam therefore takes part in the steam cracking reactions as generally known. Process steam may particularly include steam generated from the vaporization of "process water", i.e. water which was previously separated from a mixed hydrocarbon/water stream, e.g. from the process gas withdrawn from steam cracking furnaces or from a fraction thereof, particularly by gravity separation in vessels/coalescers, deoxygenation units, or using filters.

The "process gas" is the gas mixture passed through a steam cracking furnace and thereafter subjected to processing steps such as quenching, compression, cooling and separation. The process gas, when supplied to the steam cracking furnace, comprises steam and the educt hydrocarbons subjected to steam cracking, i.e. also the "feed stream" submitted to steam cracking is, herein, also referred to as process gas. If a differentiation is needed, this is indicated by language such as "process gas introduced into a steam cracking furnace" and "process gas effluent" or similar. When leaving the steam cracking furnace, the process gas is enriched in the cracking products and is particularly depleted in the educt hydrocarbons. During the subsequent processing steps, the composition of the process gas may further change, e.g. due to fractions being separated therefrom.

The term "high-purity steam" shall, in contrast to process steam, refer to steam generated from the vaporization of purified boiler feed water. High purity steam is typically specified by standards customary in the field, such as VGB-S-010-T-00 or similar. It typically does not include steam generated from process water, as the latter typically contains some further components from the process gas.

The term "feed hydrocarbons" shall refer to at least one hydrocarbon which is subjected to steam cracking in a steam cracking furnace in a process gas. Where the term "gas feed"

is used, the feed hydrocarbons predominantly or exclusively comprise hydrocarbons with two to four carbon atoms per molecule. In contrast, the term "liquid feed" shall refer to feed hydrocarbons which predominantly or exclusively comprise hydrocarbons with four to 40 carbon atoms per molecule, "heavy feed" being at the upper end of this range.

The term "electric furnace" may generally be used for a steam cracking furnace in which the heat required to heat the process gas in the cracking coils is predominantly or exclusively provided by electricity. Such a furnace may include one or more electric heater devices that are connected to an electric power supply system, either via wired connections and/or via inductive power transmission. Inside the heater device material, the applied electric current is generating a volumetric heat source by Joule heating. If the cracking coil itself is used as electric heating device, the released heat is directly transferred to the process gas by convective-conductive heat transfer. If separate electric heating devices are used, the heat released by Joule heating is indirectly transferred from the heating device to the process gas, first from the heating device to the cracking coils preferably via radiation and, to a minor extent, via convection, and then from the cracking coils to the process gas by convective-conductive heat transfer. The process gas may be preheated in various ways before being supplied to the cracking furnace.

A "fired furnace" is, in contrast, generally a steam cracking furnace in which the heat required to heat the process gas in the cracking coils is predominantly or exclusively provided by firing a fuel using one or more burners. The process gas may be preheated in various ways before being supplied to the cracking furnace.

The term "hybrid heating concept" may generally be used when, in steam cracking, a combination of electric furnaces and fired furnaces is used. In the context of the invention, it is preferably foreseen that a single cracking coil is strictly attributed to a fired or to an electric furnace, i.e. each cracking coil is either exclusively heated by electric energy or exclusively by firing.

The term "predominantly" may, herein, refer to a proportion or a content of at least 50%, 60%, 70%, 80%, 90% or 95%.

The term "rotating equipment", as used herein, may relate to one or more components selected from a compressor, a blower, a pump and a generator, such rotating equipment drivable by a source of mechanical energy such as an electric motor, a steam turbine or a gas turbine.

A "multi-stream heat exchanger" is a heat exchanger in which particularly the medium to be cooled is passed through a plurality of passages such as in a "transfer line exchanger" as e.g. mentioned in the Ullmann article mentioned at the outset.

To the knowledge of the inventors, the existing literature on electrically heated cracking furnaces is limited to the design and operation of the electric coil heating section itself. There is little information available regarding integration concepts into full furnace architectures (including preheating and quench sections), nor into wider cracker plant architectures. This is valid with exceptions to the most recent publications mentioned above, i.e. WO 2020/150244 A1, WO 2020/150248 A1 and WO 2020/150249 A1.

An efficient and effective integration of electric furnaces into a steamcracker (referred to as "steamcracking arrangement" hereinbelow) is of paramount importance for the overall plant design, in particular regarding energy management. A major difficulty arises from the fact that electrically heated furnaces do not feature a convection zone, as mentioned. This is of such importance since, as it was already mentioned, in fired cracking furnaces 40 to 60% of the overall heat input is recovered in the convection zone and can be used for various purposes.

Concepts and solutions provided according to the invention particularly are intended and suitable to fulfil the following duties or requirements which are necessary for steam cracking arrangements including electric furnace systems.

- Electrically heat a process gas stream premixed from feed hydrocarbons and steam in cracking coils from inlet temperatures between 550 and 750° C. to outlet temperatures between 800 and 900° C., thereby achieving cracking yields similar or better as the ones obtained in fired cracking furnaces.
- Preheat and, in case of liquid feeds, vaporize feed hydrocarbons from typical supply temperatures between 20 and 150° C. to the above mentioned coil inlet temperatures between 550 and 750° C. The preheating and vaporization of the feed hydrocarbons is to be made with or without previous addition of process steam, the process steam typically being supplied to the steam cracking arrangement at a temperature level between 130 and 200° C.
- Effectively and very rapidly cool down the process gas downstream of the cracking coils to temperature levels between 300 and 450° C. (for liquid feedstocks) or 150 to 300° C. (for gaseous feedstocks) in one or more multi-stream heat exchangers allowing for heat recovery from the process gas.
- Balance energy flows between furnace system and remaining steamcracker plant to ensure safe, reliable and efficient plant operation.

The invention proposes new process solutions in terms of furnace design, arrangement and operation for such a setup. In simple words the invention provides a solution to the following question: "How to balance and distribute heat quantities in a low- to zero-emission steamcracker featuring some, mostly or exclusively electric furnaces?"

The existing prior art contains no example on how to solve these tasks simultaneously, because all fired furnace integration concepts strictly rely on the existence of a convection zone, in which heat is recovered from a hot flue gas stream.

While prior publications may indicate that heat from the process gas stream may be recovered and utilized, e.g. for feed preheating or process steam generation, there is no solution provided how to supply usable process heat to the wealth of other process heat consumers in a steamcracker plant and adjacent chemical complex. While there might be suggestions to not use steam any longer as the primary energy carrier, the mentioned heat supply question is left unanswered, unless one uses electricity for all heating duties in the plant. The latter, rather trivial solution is far from the energetic optimum, because using electricity for heating purposes at low temperatures leads to significant exergy losses. In other embodiments of the prior art, steam generated is strongly superheated, with the intent of electricity generation in a steam turbine combined with a generator system. This is also a questionable solution, since generating electricity from steam originally produced in an electrically heated reactor system again leads to very high exergy losses and non-optimal resource management.

According to the invention, a method of steam cracking using a steam cracking arrangement including an electric cracking furnace without a convection zone and further including a quench cooling train is provided, wherein a process gas stream is passed at least through the electric cracking furnace and the quench cooling train. Be it noted that, while, in the following description, reference is made to arrangements, devices, streams etc. in the singular, the invention can likewise comprise embodiments where each of these items can be provided in plurality. In this connection, streams may be combined from different components or may be distributed to different components as necessary.

If reference is made here to an electric cracking furnace "without a convection zone", this relates to the absence of a zone in which a significant amount of typically more than 500 kW of process heat is continuously recovered from a flue gas stream. In other terms, an electric cracking furnace without a convection zone is a cracking furnace without carbon dioxide emission from flue gas streams that are purposely cooled down to continuously recover significant amounts of typically more than 500 kW of process heat. The furnace system may, however, feature carbon dioxide emission sources for non-process purposes, e.g. safety-related pilot burners at the outlet of gas evacuation stacks. These provide, however, significantly lower amounts of generally non-recoverable heat.

Generally, therefore, during hydrocarbon cracking operation, preferably a heat amount of not more than 1000 kW is transferred in the electric cracking furnace as sensible heat to streams other than the process gas stream passed through or withdrawn from the electric cracking furnace according to the invention. Such other streams may for example be high-purity steam streams. Expressed differently, said heat transferred in the electric cracking furnace to streams other than the process gas may also be not more than 5% or not more than 3% of the heat transferred to the process gas.

According to the invention, the quench cooling train is operated to comprise at least two distinct cooling steps, wherein in a first one of the cooling steps at least a part of the process gas stream withdrawn from the electric cracking furnace is cooled against vaporizing boiler feed water at an absolute pressure level between 30 and 175 bar, particularly between 60 and 140 bar, more particularly between 80 and 125 bar, and wherein in a second one of the cooling steps at least a part of the process gas stream withdrawn from the electric cracking furnace is cooled against a superheated mixture of feed hydrocarbons and process steam used in forming the process gas stream which is thereby heated to a temperature level between 350 and 750° C., particularly between 400 and 720° C., more particularly between 450 and 700° C.

According to a particularly preferred embodiment of the invention, a steam generation arrangement is operated in thermal association with the steam cracking arrangement and may also form part thereof, wherein using the steam generation arrangement at least superheated high pressure steam at a first pressure level of 30 and 175 bar absolute pressure and at a first temperature level and substantially no steam at a higher temperature level than the first temperature level is generated. The term "substantially no steam" shall, in this connection, particularly refer to a steam amount of less than 10% of the total steam amount generated in the steam generation arrangement.

Further according to this embodiment, the superheated high pressure steam at the first pressure level and the first temperature level is at least in part adiabatically and isenthalpically expanded to a second pressure level below the first pressure level, the second pressure level being particularly, but not necessarily, above bar absolute pressure, such that its temperature level is lowered, only by the adiabatic and isenthalpic expansion, to a second temperature level. The first temperature level is selected such that each intermediate temperature level reached at intermediate pressure levels of more than 20 bar during the adiabatic and isenthalpic expansion process is between 5 and 120 K, particularly between 10 and 100 K, further particularly between and 80 K above the dew point of steam at the respective intermediate pressure level during the adiabatic and isenthalpic expansion. In other words, the expanded steam is, by selecting the first temperature level according to the invention, kept at moderate superheating levels, while simultaneously being held with a sufficient distance from the boiling point curve throughout the process of expansion for all intermediate pressure levels above 20 bar. The latter is particularly relevant in the case of an expansion starting from a first pressure level of more than 40 bar as in such cases the two-phase region may be reached or at least temporarily passed. This is avoided according to the invention.

Limiting the level of steam superheating according to this embodiment inside the furnace system, i.e. performing a moderate superheating, is very suitable if the steam flow exported from the furnace system is solely intended for supplying process heat to consumers, the term "exported" relating in this connection to a withdrawal from the steam generation arrangement and not, or not necessarily, from an overall system. This steam may also be referred to as "dry" steam as its superheating level is selected essentially to prevent condensation, which may e.g. result in abrasion during steam transport. By mere adiabatic and isenthalpic expansion its pressure can be reduced without phase change after or during the expansion to the pressure and temperature levels required by the heat sink if the temperature levels as indicated above are observed. For any possibly applied adiabatic and isenthalpic expansion down to a minimum pressure, i.e. the second pressure level, the resulting dew point margin of the steam flow at any intermediate pressure level above 20 bar during the expansion is in the ranges already mentioned before.

By avoiding strong steam superheating according to the embodiment of the invention, the availability of quench heat for feed preheating at higher temperature levels (typically more than 300° C.) can be maximized. In embodiments comprising electric steam superheaters, as further explained below, the import of electric energy to the electric cracking furnaces can be minimized.

The invention differs from all known fired furnace integration systems by the fact that neither a feed preheating nor a steam superheating is performed against flue gas (due to the absence of a convection zone). Contrarily to the electric furnace integration concepts proposed previously, the invention explicitly foresees to use steam as a primary energy carrier, more specifically as a heat carrier to process heat consumers at various temperature levels. The steam generation and export conditions are specifically designed to suit the intended purpose of heat distribution inside the steam-cracker plant and an adjacent chemical complex.

Furthermore, the topologies used in embodiments according to the invention for feed hydrocarbon, process steam and boiler feed water preheating up to temperature levels of approximately 300° C., using solely saturated and/or moderately superheated high pressure steam and its resulting condensates, represent an inventive solution for fulfilling these process duties in an electric furnace, in which no additional waste heat from flue gas is available (unlike in fired furnaces). These solutions have the benefit of using a heat medium directly available at the furnace, thereby reducing piping needs, and of minimizing exergy losses by keeping temperature differences in heat exchangers small and preferably performing a subcooling of the condensates formed for maximum heat recovery.

By limiting the steam usage to process heat purposes only and setting steam parameters accordingly, the steam system can be operated flexibly (in relation to pressure and temperature) and can further be used as temporary energy buffer, e.g. by varying the steam superheating and/or pressure levels during operation. This is facilitated by the fact that the produced steam is not used for power generation in steam turbines, which are less tolerant with regard to variations of steam conditions than steam-based heat exchangers. The variation of electric energy import can be realized in different ways for the various embodiments, e.g. by modifying the setpoint of controlled outlet temperatures of specific heat exchangers. In the embodiment shown in FIG. 2, for example, which is further explained below, such a variation can be realized by reducing the outlet temperature of the steam-supplied heat exchanger X2, what will result in increasing total electric energy import to other heat exchangers and/or coil heating in order to maintain the same chemical production load of the furnace. In embodiments with electric steam superheating, the variation can be done in straightforward manner by varying the duty.

According to the invention, therefore, preferably no steam generated by the one or more steam generation arrangements is used in steam turbine drives delivering shaft powers of more than 1 MW, and preferably not in steam turbines or other rotating equipment as defined above at all. In other words, according to the invention no steam turbines and at least no steam turbines delivering shaft powers of more than 1 MW, are used which are supplied with steam from the steam generation arrangement(s).

The superheated high pressure steam at the first pressure level and at the first temperature level does preferably not include steam generated from process water and preferably includes only steam generated from boiler feed water. The superheated high pressure steam is therefore preferably high-purity steam as defined above. The superheated high pressure steam is preferably not used in forming the one or more process gas stream, i.e. it does not participate in the steam cracking reactions.

In other words, according to the invention only a moderately superheated high-purity steam flow is generated, as mentioned, and exported at a corresponding pressure level, i.e. the first pressure level, and for any adiabatic and isenthalpic expansion down to a minimum pressure, i.e. the second pressure level, the resulting dew point margin of the expanded steam flow is in the ranges already mentioned before.

According to the invention, as the quench cooling train, preferably a quench cooling train comprising a primary quench exchanger and a secondary quench exchanger is used, the primary quench exchanger being used to perform at least a part of the first one of the cooling steps and the secondary quench exchanger being used to perform at least a part of the second one of the cooling steps or vice versa. Corresponding embodiments of the invention are particularly further explained with reference to the appended drawings.

According to the invention, a multi-flow heat exchanger in which heat is transferred from the process gas stream withdrawn from the electric cracking furnace to a boiler feed water stream and/or a steam stream used in forming the superheated high pressure steam and/or an electric steam superheater may be used in the steam generation arrangement. Furthermore, at least a part of the feed hydrocarbons used in forming the superheated mixture of feed hydrocarbons and process steam, i.e. the process stream then to be cracked, may be preheated using at least a part of the process gas stream withdrawn from the electric cracking furnace in a multi-flow heat exchanger which is then referred to as a feed-effluent exchanger.

As the quench cooling train, a quench cooling train comprising an arrangement with three or four quench exchangers arranged in series in the process gas stream may be used according to the invention, of which at least one may be provided as the multi-flow heat exchanger just mentioned. Of this series, the first and second quench exchangers may be the primary and secondary quench exchangers described before. Heat may be transferred in a third and, if existing, in a fourth quench exchanger of such a series of three or four quench exchangers to a boiler feed water stream and/or to a steam stream used in forming the superheated high pressure steam. Alternatively, the last quench exchanger in a series of three or four quench exchangers may be used to preheat at least a part of the feed hydrocarbons used in forming the superheated mixture of feed hydrocarbons and process steam, particularly in a mixture already including process steam, particularly when an electric steam superheater is provided in an embodiment of the invention. The last quench exchanger in a series of three or four quench exchangers is also be referred to as a "tertiary" quench exchanger hereinbelow and the second last quench exchanger in a series of four quench exchangers as an "intermediate" quench exchanger. Be it noted that this specific denomination performed here for easier reference only.

Partly repeating the above, the superheated high pressure steam at the first pressure level and at the first temperature level does preferably not include steam generated from process water and/or only includes steam generated from boiler feed water, such that the superheated high pressure steam at the first pressure level and at the first temperature level is provided as high-purity superheated high pressure steam. Furthermore, as mentioned above already as well, preferably no steam generated by the one or more steam generation arrangements is used in steam turbine drives delivering shaft powers of more than 1 MW.

As also mentioned, the steam cracking arrangement is operated, according to a particularly preferred embodiment of the invention, in different operating modes, using differing electric energy amounts, which becomes possible as a result of the flexibility of steam generation and use according to the invention. In this way, the invention can also be used for stabilizing an electric grid.

For further details in relation to the steam cracking system provided according to the invention and preferred embodiments thereof, reference is made to the explanations relating to the inventive method and its preferred embodiments above. Advantageously, the proposed arrangement is adapted to perform a method in at least one of the embodiments explained before in more detail.

Summarizing again what was said above, the invention proposes novel concepts which ensure that all duties or requirements listed above are fulfilled for steamcracker furnaces in the context of highly electrified steamcracker designs.

The solution to limit the superheating of superheated high pressure steam provided according to an embodiment of the invention particularly breaks with the current state-of-the-art in current steamcracker designs based on fired furnaces and turbine-driven large rotating machinery. This technological choice represents a very efficient solution in the context of highly electrified steamcracker designs.

Indeed, the current practice of producing highly superheated high pressure steam in the furnace section (where dew point margins are typically higher than 150 K at the furnace outlet) is driven by the abundance of thermal waste energy in the furnace's convection section and its possible use in steam turbines for driving compressors and pumps. Reduced pressure steam taken from turbine extractions or turbine outlets is furthermore used for providing process heat at various levels.

In highly electrified cracker separation trains, the use of electric compressor drives instead of steam turbines leads to a reduction of exergy losses in the steamcracker plant. Furthermore, there is no more efficient use for highly superheated high pressure steam in the separation train. Hence, by reducing the level of superheating, the invention leads to the use of a large portion of the thermal energy recovered in the quench section for the necessary preheating of the feed hydrocarbon/process steam mixture, either in a direct feed-effluent heat exchanger or indirectly via superheated high pressure steam generation and use of that steam in feed preheating steps.

By maximizing the use of quench heat usage for feed preheating, the total import of electric energy to the furnace is reduced, thereby reducing the furnace's operational cost, facilitating the furnace integration into electrical grid, and reducing the overall exergy loss in the furnace section.

Among the embodiments shown, the variants in which the primary quench exchanger is used in steam generation offer the benefit of fastest cracked gas cooling and reaction quenching (high heat transfer coefficient by boiling water), whereas the variants with the primary quench exchanger being designed as feed-effluent exchanger offer the benefit of minimum electric energy import.

The moderate superheating in the given range according to an embodiment of the invention further allows a straightforward and flexible heat supply to process heat consumers, as the distribution to consumers at different temperature levels can simply be done by monophasic, adiabatic and isenthalpic expansion of the moderately superheated steam exported by the furnaces, without need for letdown stations for entire steam levels involving additional boiler feed water injection for desuperheating and/or turbine stages.

As mentioned above, the preheating at lower temperatures reduces piping volumes and allows maximum heat recovery by subcooling steam condensates.

In terms of dynamic behavior, the possibility to balance and buffer changes in electricity import with the steam system facilitates the integration of such furnace systems in industrial complexes preferably supplied with renewable electricity.

Further features and embodiments of the invention are listed hereinbelow. All these features and embodiments can be combined with the features and embodiments described hereinbefore and hereinafter without limitation, as far as being encompassed by the scope of the claims and as far as technically feasible or sensible.

- The invention is preferably combined with a separation train in which all gas compressors or pumps with power duties above 1 MW are driven by electric motors.
- The exported superheated high pressure steam is most advantageously distributed to various steam pressure levels by adiabatic and isenthalpic expansion elements. Singular heat consumers (e.g. with critical fouling service) may further include an additional desuperheating step (which may be performed by direct water injection or by using a saturation drum).
- Steam cracking arrangements comprising features according to the invention may be operated according to any possible electric heating principle such as direct resistive coil heating, indirect radiative coil heating by electric heating elements, and coil heating using inductive power transmission. The steam cracking arrangement may include other units for steam generation from electric energy (e.g. electric heat pump systems and electric boilers).
- The exported superheated steam can be expanded to pressure steam levels below bar absolute pressure, e.g. to supply medium and low pressure steam consumers. The selection of 20 bar absolute pressure for the second pressure level is chosen to facilitate the definition of the curve envelopes for the initial steam superheating. When expanded to pressures below 20 bar absolute pressure, higher values of dew point margins may occur, without limiting the scope of the invention.
- In addition to the inherent energy storage possibility through variation of steam superheating/pressure, the invention can further be combined with dedicated energy storage systems, e.g. latent heat storage systems or similar.

The invention and embodiments thereof are further explained in connection with the appended drawings.

Figure 2:
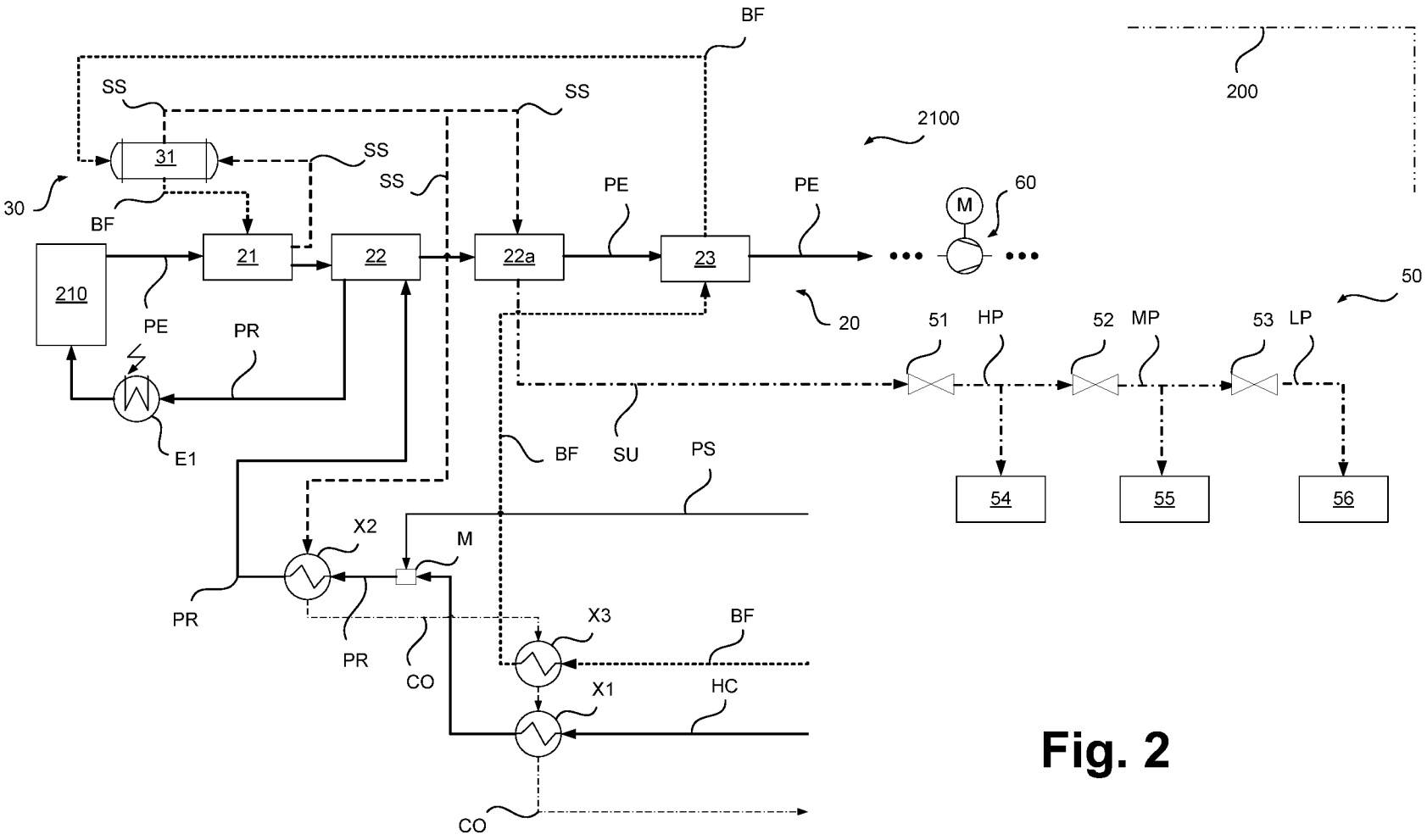
FIGS. 2 to 9 illustrate embodiments of the invention.

In FIG. 2, a steam cracking arrangement 2100 according to an embodiment of the invention, used in implementing a method of steam cracking according to an embodiment of the invention, and optionally being part of a system according to the invention is illustrated. As in the subsequent Figures showing steam cracking arrangements as well, method steps of the method may be realized by corresponding process units or devices used and explanations relating to method steps may therefore likewise relate to such process units and devices and vice versa. Repeated explanations are omitted for reasons of conciseness only and mixed language describing the arrangements or systems and the methods according to the embodiments of the invention is used for clarity. If components are described in the singular, this does not exclude that such components are provided in plurality. The steam cracking arrangement 2100, such as the other steam cracking arrangements shown below, may be part of a system 200 according to an embodiment of the invention which may include a plurality of further components and whose possible system boundaries are very schematically illustrated in FIG. 2 only.

In FIGS. 2 to 9, solid arrows indicate hydrocarbon feed, process steam, process gas, or cracked gas streams and streams formed therefrom, such as hydrocarbon fractions. Finely dotted arrows indicate liquid boiler feed water streams, while dashed arrows indicate saturated high-purity steam streams, and dash-dotted arrows indicate superheated high-purity steam streams. Condensate streams are indicated with double-dash dotted arrows.

The steam cracking arrangement 2100 includes using an electric steam cracking furnace 210, as generally described before, also referred to as an "electric coilbox". No convection zone is present.

Process steam PS, particularly at a temperature level of about 185° C. is mixed in a mixing nozzle M with a stream of feed hydrocarbons HC which is preheated in a heat exchanger X1. A process stream PR thus formed is further heated in a heat exchanger X2 to a temperature level of particularly about 300° C. The heat exchangers X1 and X2 can also be combined, particularly if the process steam PS is added upstream of the heat exchanger X1.

Four quench exchangers 21, 22, 22*a* and 23 are arranged in series in a process gas pathway downstream of the electric steam cracking furnace 210, forming a quench cooling train 20 of the steam cracking arrangement 2100. As mentioned, and for reference purposes only, the first and second quench exchangers 21, 22 in this series may be the primary and secondary quench exchangers described before. The last quench exchanger 23 in the series may also be referred to as a tertiary quench exchanger and the second last quench exchanger 22*a* in the series as an intermediate quench exchanger. Alternatively, the quench exchanger 21 and the quench exchanger 22*a* may both be referred to as secondary quench exchangers.

The process stream PR is, before being additionally heated in an electric heater E1 to a temperature level of particularly about 660° C. and supplied to the electric steam cracking furnace 210 as a feed stream, preheated in the quench exchanger 22. The process stream is, as a cracked gas, and now indicated PE for clarity, withdrawn from the cracking furnace 210 and passed through the quench exchangers 21, 22, 22*a* and 23. The process stream PE effluent from the electric steam cracking furnace 210 is withdrawn from the electric steam cracking furnace 210 at a temperature level of particularly about 840° C., from the quench exchanger 21 at a temperature level of particularly about 550° C., from the quench exchanger 22*a* at a temperature level of particularly about 340° C. and from the quench exchanger 23 at a temperature level of particularly about 200° C.

Thereafter the process stream PE may be, as only shown in FIG. 2, subjected to any type of processing which includes, according to an embodiment of the invention, compression in a compressor 60, particularly a process gas compressor, which is driven by an electric motor M. As to further details, reference is made to the explanations above. Particularly a separation train is provided in which all or essentially all compressors are driven electrically.

A steam generation arrangement 30 is provided and includes a steam drum 31 and other components used in generating steam. Generally, if throughout the description, reference is made to a component belonging to one arrangement or group of components primary described with a certain function, this does not exclude that this component is not also part of a different arrangement or group of components having an additional or different function, as typical for a plant comprising interconnected parts. For example, the quench exchanger 21, the quench exchanger 22 and the quench exchanger 23 are described here as being part of the cooling train 20, but they may also be integrated into the steam generation arrangement 30.

Boiler feed water BF, as also illustrated with dotted arrows, is heated in a heat exchanger X3 to a temperature level of particularly about 180° C. and in the quench exchanger 23 to a temperature level of particularly about 290° C. before being supplied to the steam drum 31 from which a stream of boiler feed water BF is also passed to the quench exchanger 21 to be evaporated. Saturated steam SS, as also illustrated with dashed arrows, which is formed in the steam drum and which may be provided at a temperature level of particularly about 325° C. and a pressure level of particularly about 122 bar absolute pressure, may in part be used to operate the heat exchangers X2, X3 and X1 wherein in the heat exchanger X2 a condensate CO is formed which is subcooled in the heat exchangers X3 and X1.

A remaining part of the saturated steam SS is superheated in the quench exchanger 22*a*, forming (moderately) superheated high pressure steam SU, as also illustrated with dash-dotted arrows. Parameters of the superheated high pressure steam SU have been extensively described before. In the embodiment shown, this may have a temperature of about 375° C. and an absolute pressure of about 121 bar. In a steam utilization arrangement, which is denoted 50 for reference purposes only, the superheated high pressure steam SU is used for heating purposes but preferably not substantially for driving rotary equipment. Herein, the superheated high pressure steam SU is adiabatically and isenthalpically expanded using expansion units 51, 52, 53, forming high pressure steam HP, medium pressure steam MP and low pressure steam LP which is supplied to heat consumers 54, 55, 56. Steam (high-pressure or super-high-pressure steam) exported from all furnaces may be collected in a corresponding steam header, i.e. a large-volume piping system which distributes the steam over the plant to the different consumers. The supply connection to the lower pressure steam headers is made from this highest pressure header. In conventional plants, such a steam header is operated at approx. constant pressure (for operation of the turbines), which is slightly below the steam export pressure at the furnace outlet. According to embodiments of the invention, the pressure level of the highest pressure steam header can be varied more extensively, to achieve an advantageous buffer effect.

Summarizing the explanations to FIG. 2 and the steam cracking arrangement 2100 shown, the process gas PE is in a first step (in the quench exchanger 21) rapidly and effectively cooled against vaporizing boiler feed water BF, similarly to the state-of-the-art in fired furnaces. In a second step (in the quench exchanger 22), the process gas PE is cooled in a feed-effluent exchanger against the process gas PR which is preheated before being fed to the electric cracking furnace 11. In the embodiment shown in FIG. 2, a quench exchanger 22*a* can be provided to cool down the process gas PE while moderately superheating a portion of the saturated steam SS generated in the quench exchanger 21.

Figure 3:
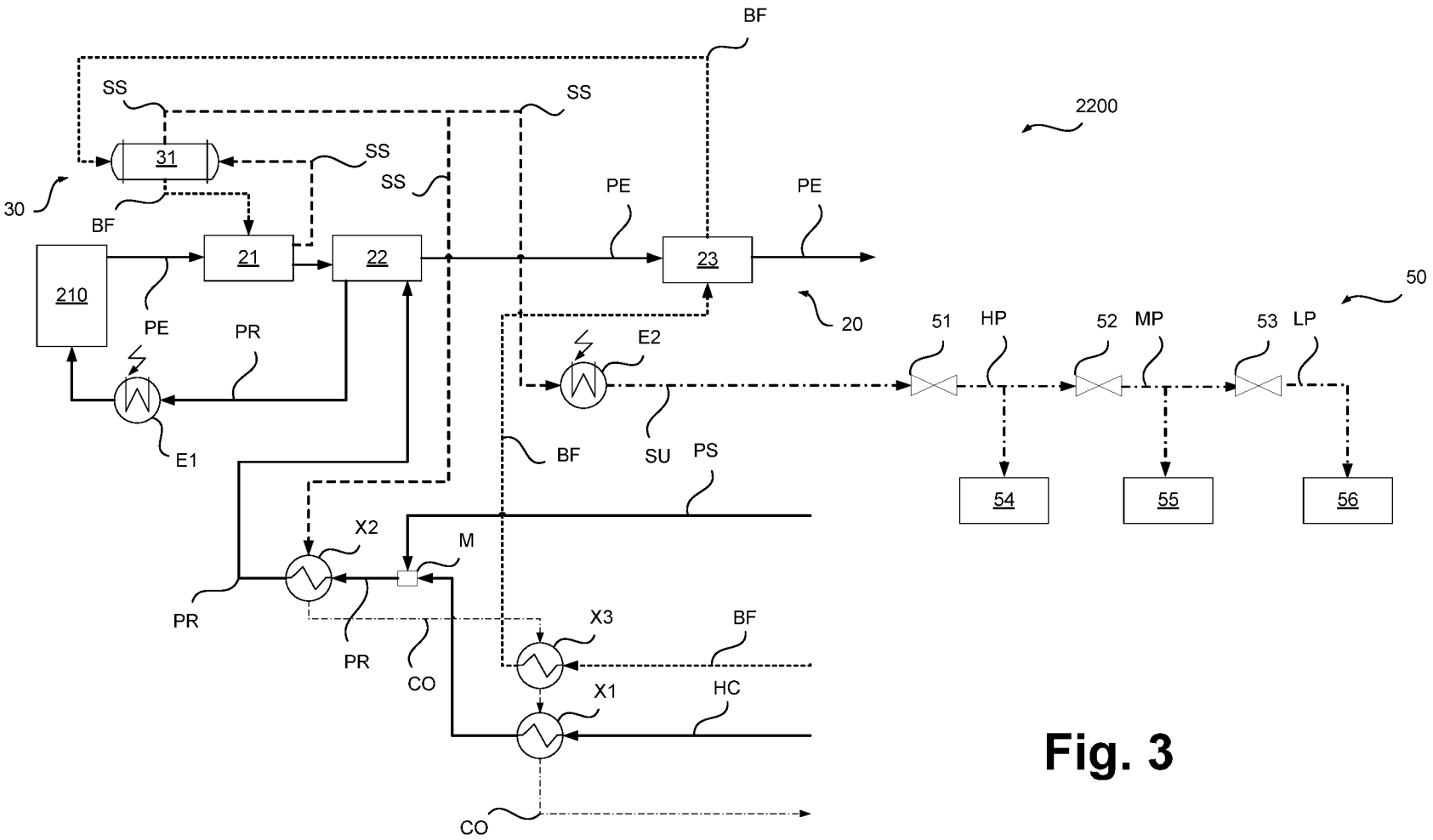

In FIG. 3, a further steam cracking arrangement 2200 according to an embodiment of the invention is illustrated. Generally, the explanations relating to the steam cracking arrangement 2100 according to FIG. 1 likewise apply to the steam cracking arrangement 2200 according to FIG. 3 and only differences will be explained below.

In the steam cracking arrangement 2200 according to FIG. 3, the quench exchanger 22*a* is omitted and an electric steam superheater E2 is provided instead. The process gas PE is withdrawn here from the quench exchanger 22 at a temperature level of particularly about 340° C.

Figure 4:
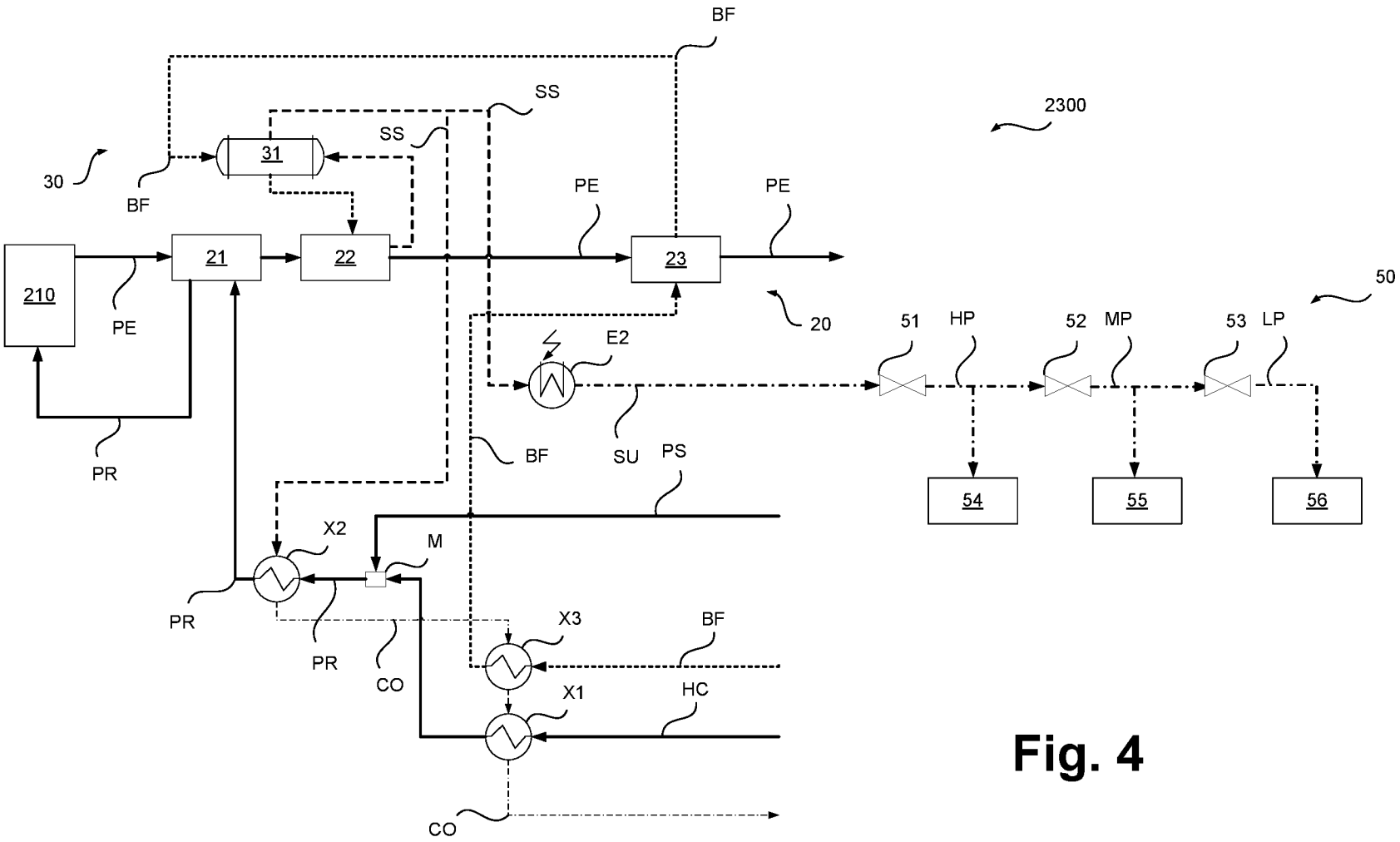

In FIG. 4, a further steam cracking arrangement 2300 according to an embodiment of the invention is illustrated. Generally, the explanations relating to the steam cracking arrangement 2200 according to FIG. 3, based on the explanations for the steam cracking arrangement 2100 according to FIG. 2 apply to the steam cracking arrangement 2300 according to FIG. 4 and only differences will be explained below.

In the steam cracking arrangement 2300 according to FIG. 4, again no quench exchanger 22*a* is present and an electric steam superheater E2 is provided instead. In the steam cracking arrangement 2300 according to FIG. 4, also the electric heater E1 is omitted. Furthermore, the process gas stream PR heated in the heat exchanger X2 is further heated in the quench exchanger 21 and the steam drum 31 is connected with the quench exchanger 22.

The process gas PE effluent from the electric steam cracking furnace 210 is withdrawn from the quench exchanger 22 at a temperature level of particularly about 340° C. The process stream PE is withdrawn from the quench exchanger 21 at a temperature level of particularly about 525° C.

In the embodiment shown in FIG. 4, therefore, the first two quenching steps are inverted, meaning that the effluent process gas PE is first cooled against the feed process gas PR to be preheated, and then against evaporating boiler feed water BF.

In such an embodiment there is no need for an electric feed preheater, as sufficiently high preheating temperatures can be reached in the quench exchanger 21. The high pressure steam to be exported is again moderately superheated, wherein both variants from FIG. 2 and FIG. 3 can be used for superheating the steam.

All three embodiments shown in FIGS. 2 to 4 are specifically designed for electric cracking furnaces 210 operating with light (gaseous) feedstocks, most preferably consisting mostly of ethane. Therefore, all these embodiments feature a quench exchanger 23 which, in accordance with today's industrial practice, further cools the cracked gas to temperature levels down to 200° C. while particularly preheating the boiler feed water fed to the steam drum 31.

Moreover, the initial preheating (at temperature levels below 300° C.) of hydrocarbon feed HC and process steam PS after mixing to form the process stream is done by using saturated steam in the heat exchanger X2. The resulting high-pressure condensate CO can further be used in other preheating steps mentioned.

Figure 5:
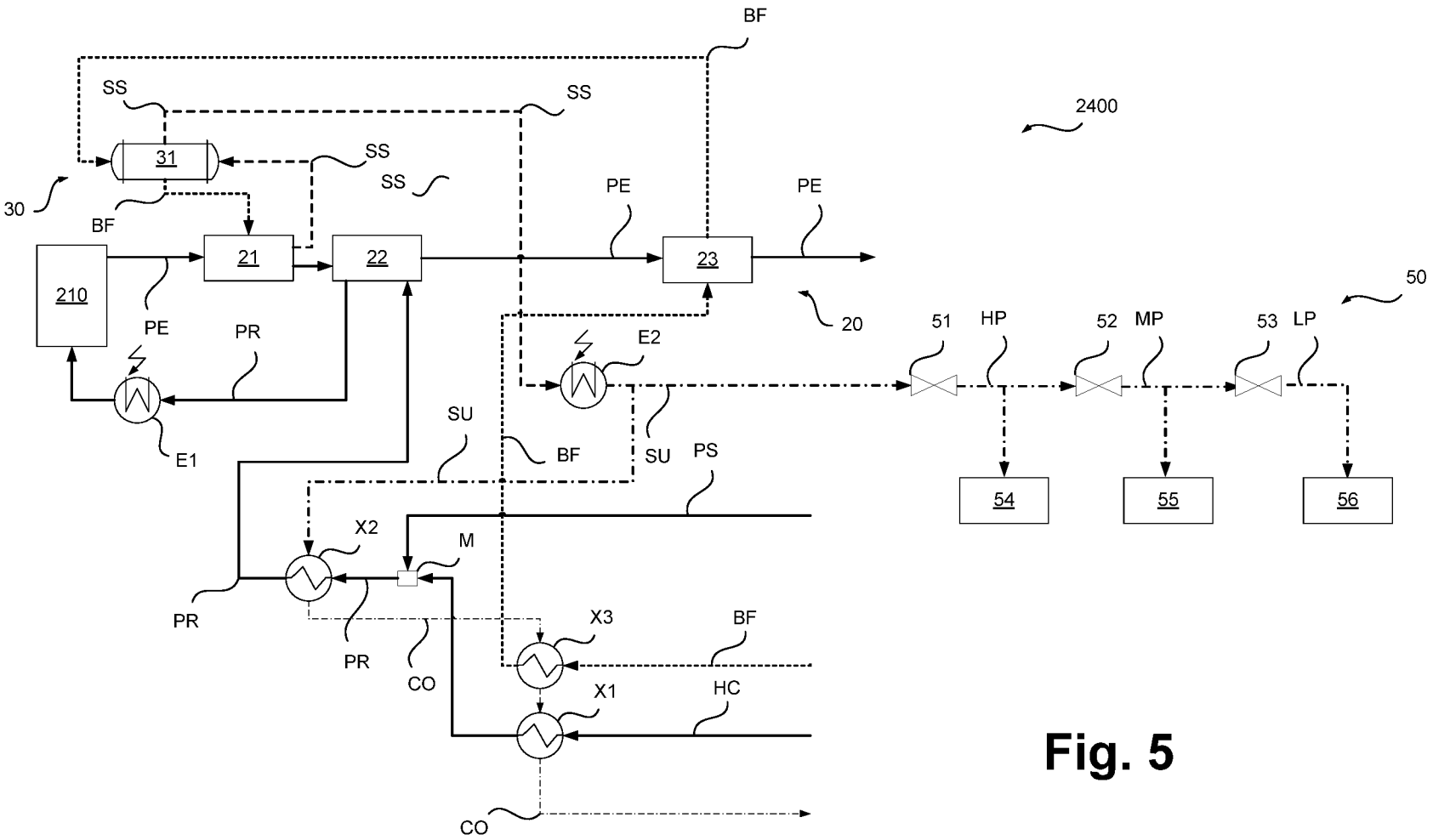

In FIG. 5, a further steam cracking arrangement 2400 according to an embodiment of the invention is illustrated. Generally, the explanations relating to the steam cracking arrangement 2200 according to FIG. 3, based on the explanations for the steam cracking arrangement 2100 according to FIG. 2 apply to the steam cracking arrangement 2400 according to FIG. 5 and only differences will be explained below.

In the steam cracking arrangement 2400 according to FIG. 5, again no quench exchanger 22*a* is present and an electric steam superheater E2 is provided instead. Instead of a part of the saturated steam SS, a part of the superheated steam SU is now provided to the heat exchanger X3. The process stream PR may therefore particularly be heated in the heat exchanger X2 to a temperature level of particularly about 330° C. such that less heat is withdrawn in the quench exchanger 22 and the process stream PE effluent cooled therein is withdrawn therefrom at a temperature level of particularly 370° C.

The embodiment of FIG. 5 particularly illustrates that alternatively to the embodiments shown before moderately superheated steam SU can also be used for securing the initial preheating of the hydrocarbon feed HC and process steam PS after forming the process stream PR.

Figure 6:
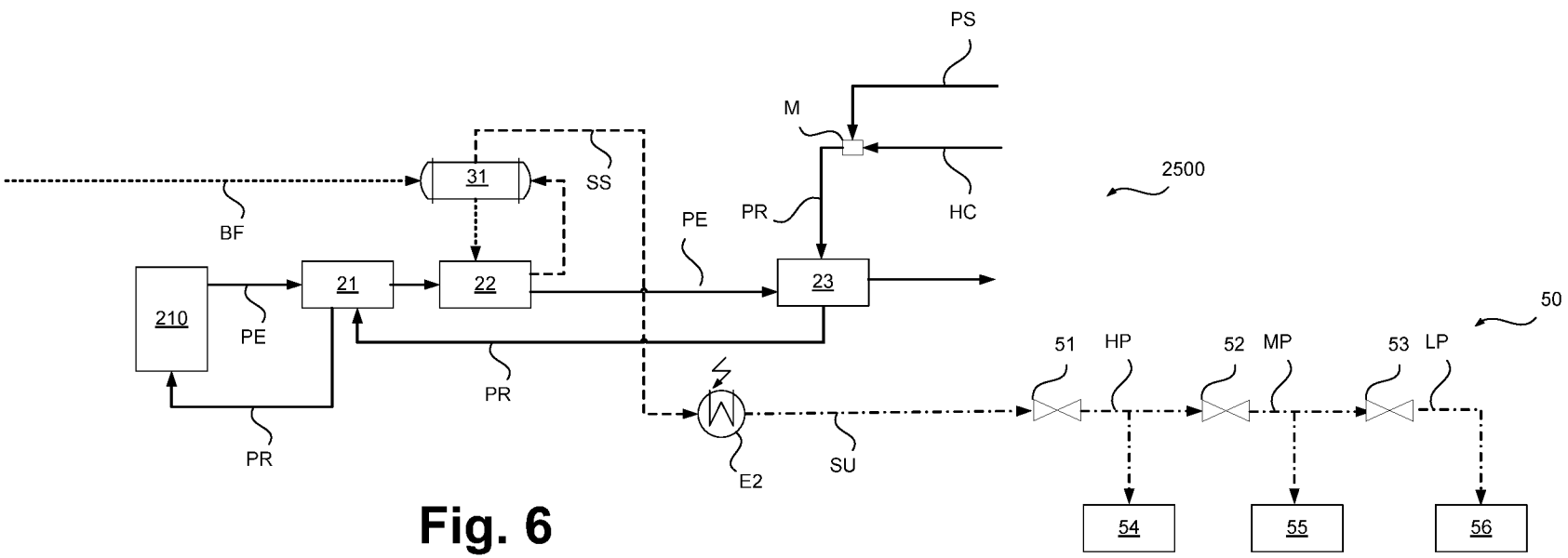

In FIG. 6, a further steam cracking arrangement 2500 according to an embodiment of the invention is illustrated. Generally, the explanations relating to the main components of the steam cracking arrangement 2100 according to FIG. 2 apply to the steam cracking arrangement 2500 according to FIG. 6 as well but a number of differences are present and will be explained below.

In the steam cracking arrangement 2500 according to FIG. 6, process steam PS at a temperature level of particularly about 185° C. is mixed in a mixing nozzle M with feed hydrocarbons HC, as above, to form a process stream PR at a temperature level of particularly about 120° C. The process stream PR is further heated in the quench exchanger 23 to a temperature level of particularly about 280° C. and in the quench exchanger 21, as before, to a temperature level of particularly about 660° C. before being supplied to the electric steam cracking furnace 210. The process gas PE effluent is withdrawn from the electric steam cracking furnace 210 at a temperature level of particularly about 840° C., from the quench exchanger 21 at a temperature level of particularly about 510° C., from the quench exchanger 22 (no further quench exchanger 22*a* is present) at a temperature level of particularly about 340° C. and from the quench exchanger 23 at a temperature level of particularly about 200° C.

Boiler feed water BF is provided to the steam drum 31 which is connected with the quench exchanger 22. Saturated steam SS may be generated at a pressure level of about 122 bar absolute pressure and at a temperature level of about 325° C. This is superheated, forming superheated steam SU with the parameters given above, in an electric heater E2.

The embodiment shown in FIG. 6 includes a further option for securing the initial preheating of the hydrocarbon feed HC and process steam PS after forming the process stream PR, where the quench exchanger 23 is designed as a feed-effluent exchanger. This possibility can be also combined with embodiments such as for example shown in FIGS. 2, 3 and 5.

Figure 7:
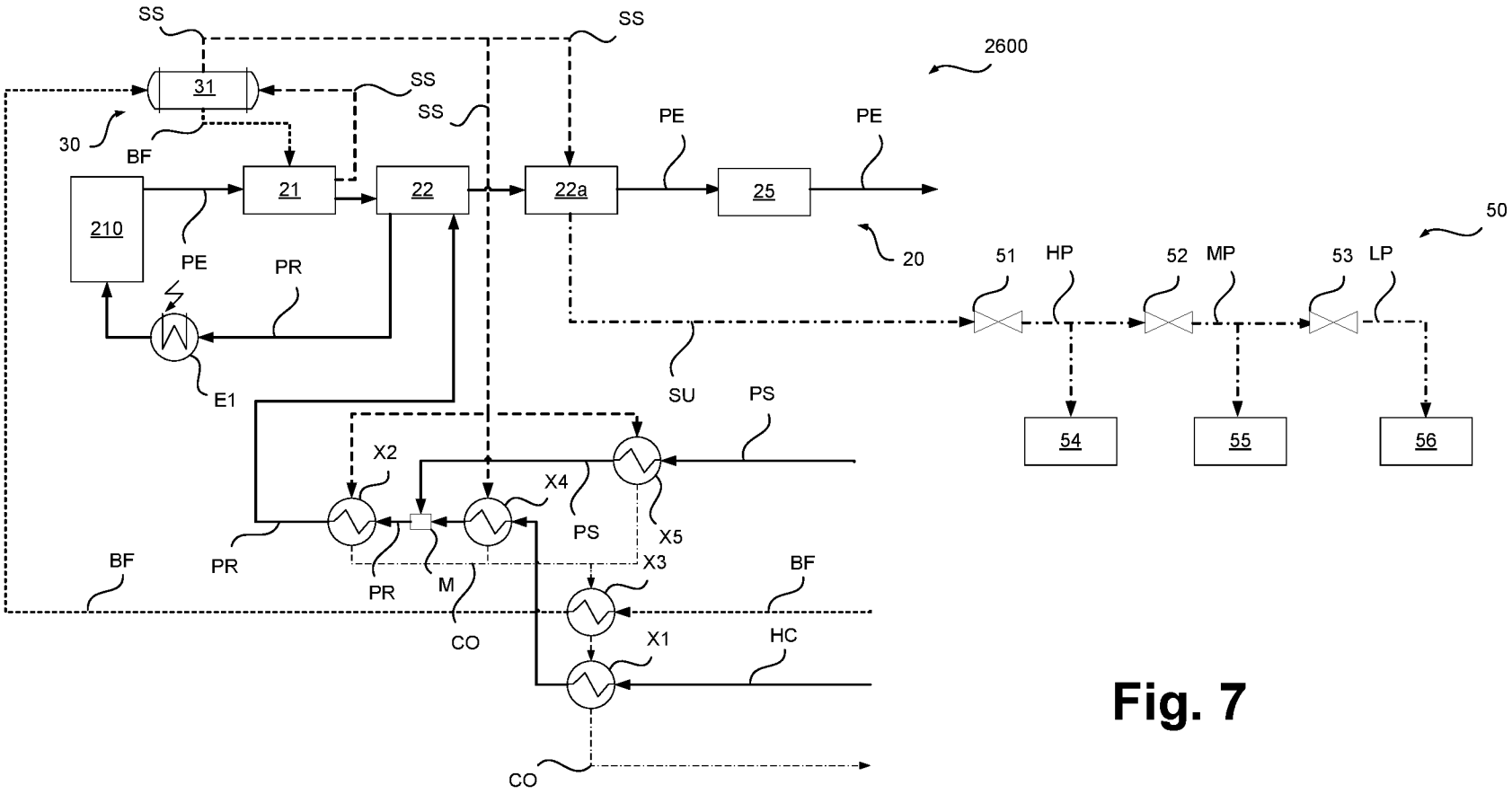

In FIG. 7, a further steam cracking arrangement 2600 according to an embodiment of the invention is illustrated. Generally, the explanations relating to the steam cracking arrangement 2200 according to FIG. 3, based on the explanations for the steam cracking arrangement 2100 according to FIG. 2 apply to the steam cracking arrangement 2600 according to FIG. 7 and only differences will be explained below.

In the steam cracking arrangement 2600 according to FIG. 7, no quench exchanger 23 is present and an oil quench 25 is used instead. Boiler feed water BF is therefore heated in heat exchanger X3 only, particularly to a temperature level of about 260° C., before being passed to the steam drum 31. A further heat exchanger X4 is provided, heating the feed hydrocarbons further before being mixed with the process steam PS in the mixing nozzle M. The process steam PS is likewise, in a further heat exchanger X5, heated before. The heat exchangers X2, X4 and X5 are operated with saturated steam SS and condensate streams are collected before being, as described before, used in the heat exchangers X1 and X3.

In the steam cracking arrangement 2600 according to FIG. 7, process steam PS is initially provided at a temperature level of particularly about 180° C. The temperature level of the process stream PR downstream of the heat exchanger X2 is particularly about 300° C. Heating in the electric heater E1 is particularly performed to a temperature level of about 630° C. The process gas PE effluent is withdrawn from the electric cracking furnace 210 at a temperature level of particularly about 870° C., from the quench exchanger 21 at a temperature level of particularly about 600° C., from the first quench exchanger 22 at a temperature level of particularly about 390° C., from the quench exchanger 22*a* at a temperature level of particularly about 380° C. and from the oil quench 25 at a further suitable temperature level. The saturated steam generated in the steam drum 21 is provided at a pressure level of particularly about 122 bar absolute pressure and at a temperature level of particularly about 325° C. The superheated high pressure steam SU downstream of the quench exchanger 22*a* is provided at a pressure level of particularly about 121 bar absolute pressure and at a temperature level of particularly about 380° C.

Figure 8:
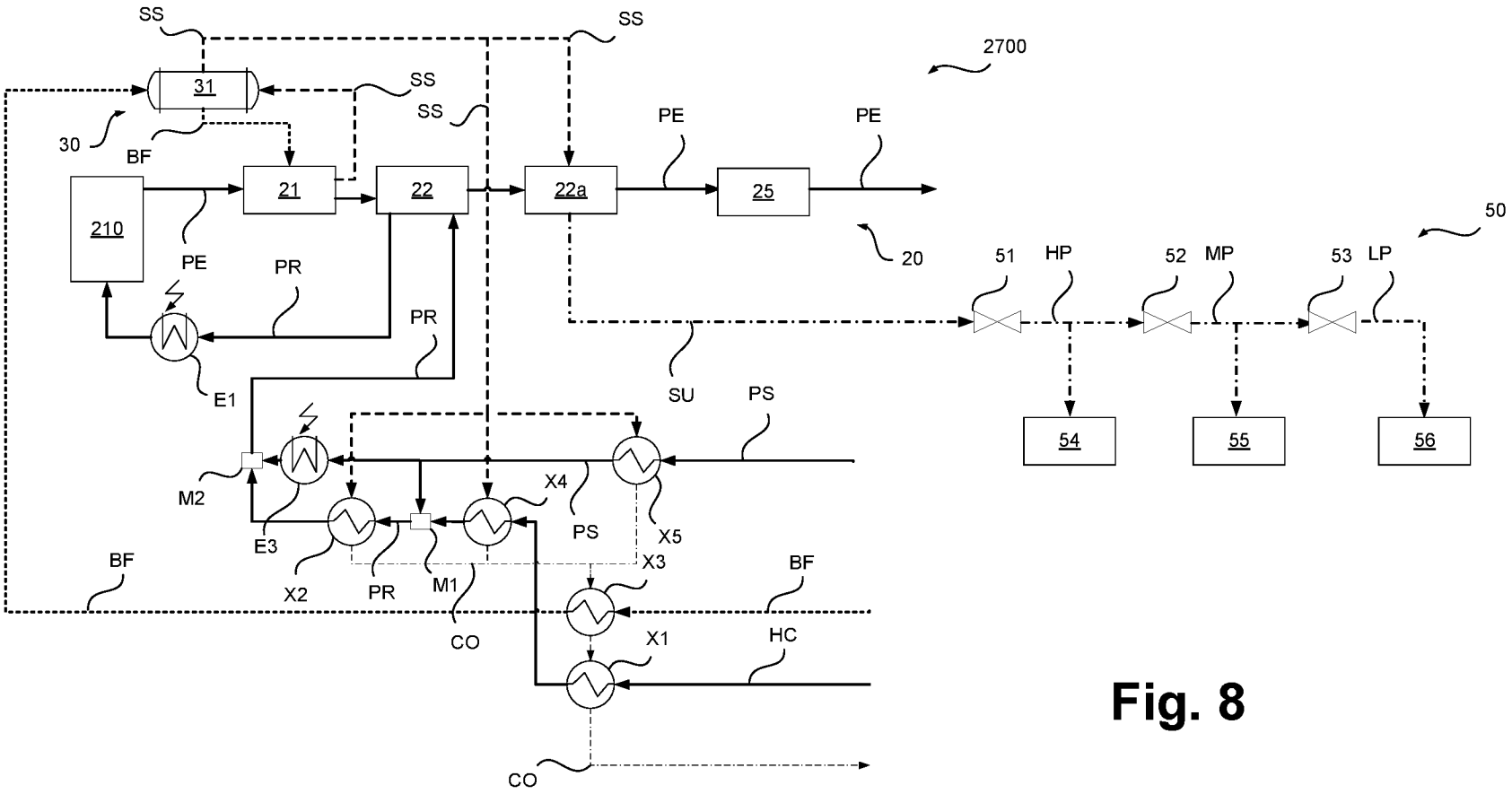

In FIG. 8, a further steam cracking arrangement 2700 according to an embodiment of the invention is illustrated. Generally, the explanations relating to the steam cracking arrangement 2600 according to FIG. 7, based on the explanations for the steam cracking arrangement 2100 according to FIG. 2 apply to the steam cracking arrangement 2700 according to FIG. 8 and only differences will be explained below.

In the steam cracking arrangement 2700 according to FIG. 8, process steam PS is successively admixed to the feed hydrocarbons HC in a first and a second mixing nozzle M1, M2, where the process steam PS admixed in the second mixing nozzle M2 is further heated in a further electric heater E3.

As alternative process variants, FIGS. 7 and 8 show exemplary embodiments of the invention as applied for an electric furnace 210 operating on liquid feedstock and heavy liquid feedstock, respectively. In such embodiments, there is no quench exchanger 23, analogously to fired liquid feedstock furnaces. The feed preheating section is typically more complex, featuring e.g. additional feed preheating steps (see FIGS. 7 and 8, incl. electric process steam superheater usage for heavy liquid feedstocks) and/or one or more process steam superheating steps in multiflow heat exchangers. Nevertheless, the embodiments shown in FIGS. 7 and 8 are straightforward adaptations of the embodiment shown in FIG. 2. Consequently, the variants presented by the embodiments shown in FIGS. 3 to 5 can analogously be applied to liquid feed furnaces as shown in FIGS. 7 and 8, as they were applied to the gas feed furnace of FIG. 2.

Figure 9:
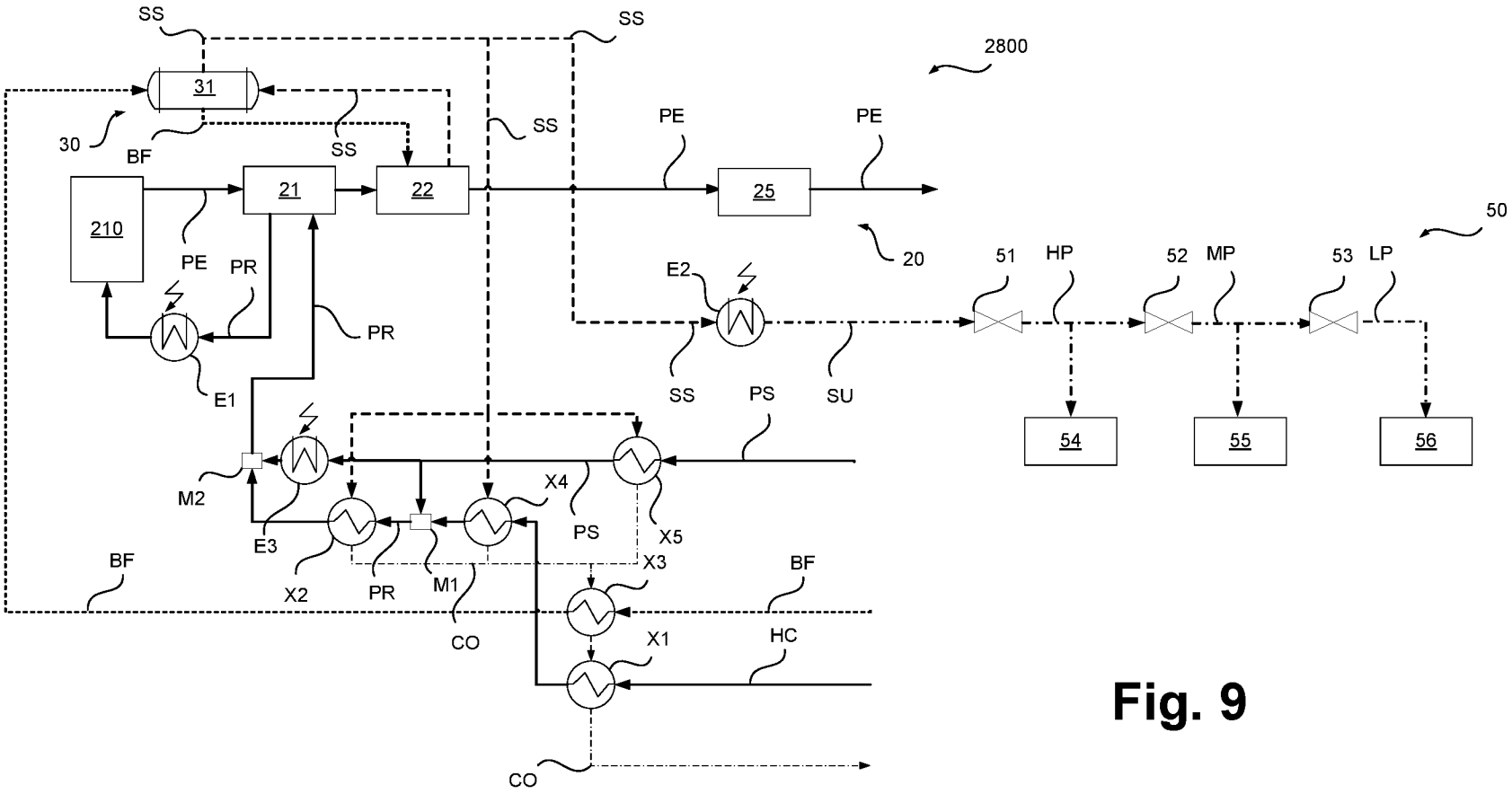

In FIG. 9, a further steam cracking arrangement 2800 according to an embodiment of the invention is illustrated. Generally, the explanations relating to the steam cracking arrangement 2700 according to FIG. 8, based on the explanations for the steam cracking arrangement 2100 according to FIG. 2 apply to the steam cracking arrangement 2800 according to FIG. 9 and only differences will be explained below.

Similar to the steam cracking arrangement 2200 according to FIG. 3 again, the quench exchanger 22*a* is omitted and an electric steam superheater E2 is provided instead. As an exemplary variant, FIG. 9 shows a process variant for a heavy liquid feed furnace analogous to the gas feed variant shown in FIG. 4 (with the quench exchanger 21 designed as feed-effluent exchanger).

Figure 10:
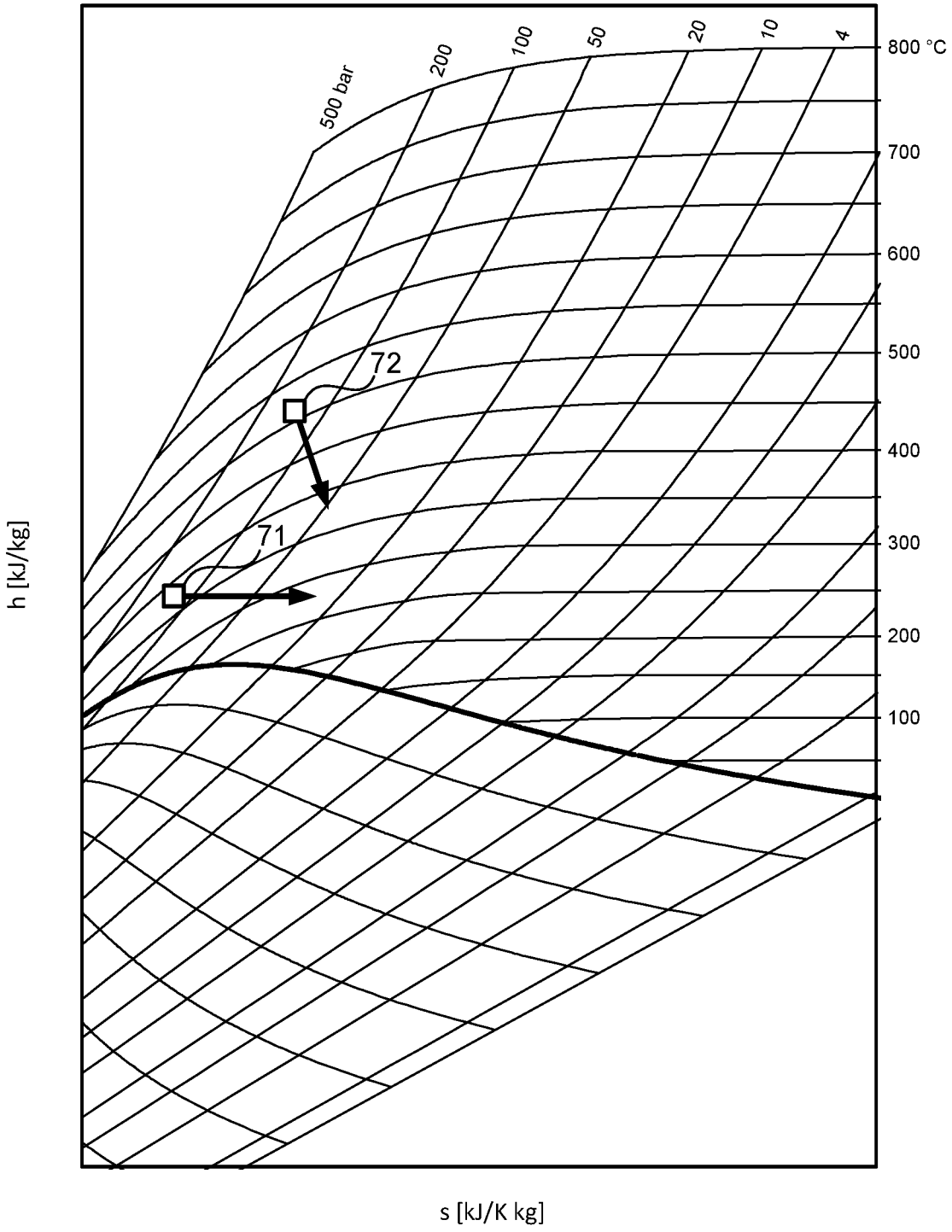
FIGS. 10 to 12 illustrate advantages of embodiments of the invention.

In FIG. 10, a Mollier (enthalpy/entropy) diagram with an entropy s in kJ/(K*kg) displayed on the horizontal axis and an enthalpy h in kJ/kg displayed on the vertical axis is shown for water. With a point 71, a moderate superheating as used according to embodiments of the invention is indicated while with a point 72, a high superheating as used according to the prior art is indicated. An adiabatic and isenthalpic expansion performed according to the invention and embodiments thereof, characteristic of a state change in valves or reducers when the steam is intended to be used for heating purposes only, is displayed with an arrow starting from point 71 while polytropic expansion performed according to the prior art and not according to the invention, characteristic of a state change in steam turbines when the steam is intended to be first used for mechanical purposes prior to its use for heating purposes, is displayed with an arrow starting from point 72.

Figure 11:
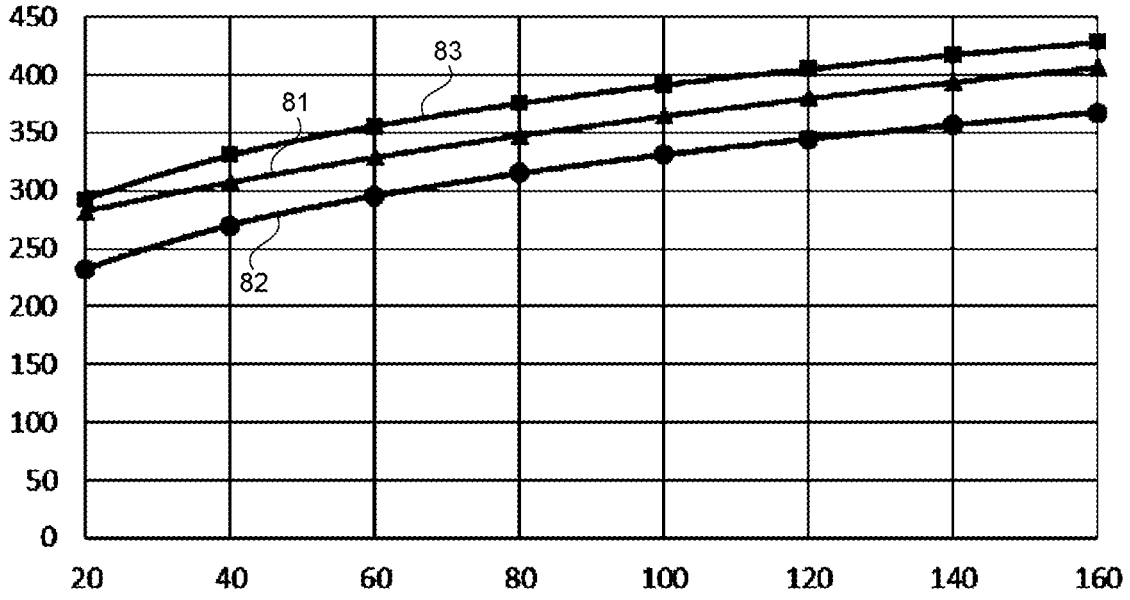

According to the invention, by mere isenthalpic expansion the pressure can be reduced without phase change to the pressure and temperature levels required by the heat consumer. An exemplary temperature evolution curve 81 of such an isenthalpic state change (featuring a supporting point at 380° C. and 120 bar absolute pressure) is shown in FIG. 11 for a pressure range between 20 and 160 bar absolute pressure, altogether with corresponding most preferred curve envelopes 82 and 83 (with +20 K and +80 K dew point margins). In FIG. 11, an absolute pressure in bar is indicated on the horizontal axis and a temperature in ° C. is indicated on the vertical axis.

Figure 12:
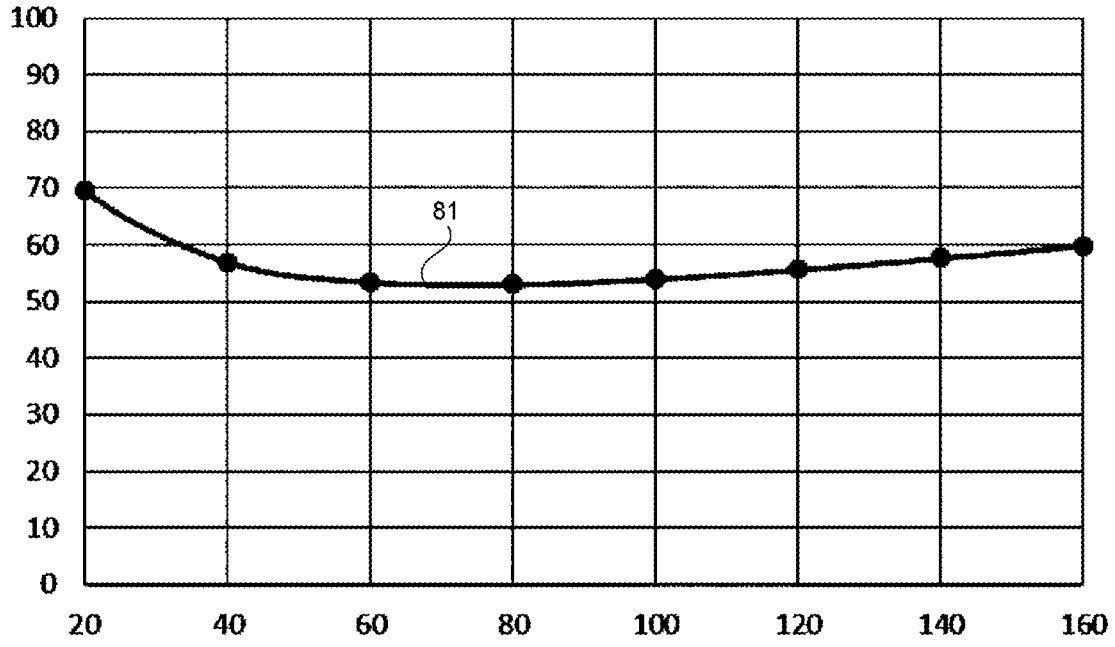

The corresponding dew point margin for the same exemplary isenthalpic curve 81 is shown in FIG. 12 for the same pressure range. In FIG. 12, again an absolute pressure in bar is indicated on the horizontal axis while temperature difference values in K are indicated on the vertical axis.

The invention claimed is:

1. A method of steam cracking, comprising:

providing a steam cracking arrangement including:

an electric cracking furnace without a convection zone; and a quench cooling train;

forming a feed stream from feed hydrocarbons and process steam;

supplying at least a part of the feed stream to the electric cracking furnace;

withdrawing a cracked gas stream from the electric cracking furnace; and passing at least a part of the cracked gas stream through the quench cooling train;

wherein the quench cooling train is operated in at least two distinct cooling steps arranged in either order, wherein:

in a first one of the cooling steps at least a part of the cracked gas stream is cooled against vaporizing boiler feed water at an absolute pressure level between 30 and 175 bar; and in a second one of the cooling steps at least a part of the cracked gas stream is cooled against at least a part of the feed stream which is thereby heated to a temperature level between 35° and 750° C.; and wherein the method further comprises producing saturated steam in at least one of the first one of the cooling steps and the second one of the cooling steps of the quench cooling train, and indirectly heating at least one of the feed stream or a part thereof, the feed hydrocarbons or a part thereof, boiler feed water or a part thereof, and dilution steam or a part thereof using at least a part of the saturated steam, thereby condensing said saturated steam.

2. The method according to claim 1, wherein, a heat amount of not more than 1000 kW is transferred in the electric cracking furnace as sensible heat to streams other than the feed stream or the cracked gas stream.

3. The method according to claim 2, wherein the quench cooling train includes a primary quench exchanger and a secondary quench exchanger, wherein the primary quench exchanger performs at least a part of the first one of the cooling steps and the secondary quench exchanger performs at least a part of the second one of the cooling steps or vice versa.

4. The method according to claim 3, further comprising:

providing a steam generation arrangement operated in thermal association with the steam cracking arrangement; and using the steam generation arrangement to produce at least superheated high pressure steam at a first pressure level of 30 and 175 bar absolute pressure and at a first temperature level;

wherein:

no steam at a higher temperature level than the first temperature level is generated;

the superheated high pressure steam at the first pressure level is at least in part adiabatically and is enthalpically expanded to a second pressure level below the first pressure level such that its temperature level is lowered to a second temperature level; and the first temperature level is selected such that the second temperature level is between 5 and 120 K above a dew point of steam at the second pressure level.

5. The method according to claim 4, wherein the steam generation arrangement comprises:

a multi-flow heat exchanger in which heat is transferred from the cracked gas stream or a part thereof to boiler feed water and/or to a steam stream used in forming the superheated high pressure steam; and/or an electric steam superheater.

6. The method according to claim 3, wherein at least a part of the feed hydrocarbons used in forming the feed stream are preheated using at least a part of the cracked gas stream in a multi-flow heat exchanger.

7. The method according to claim 5, wherein the quench cooling train comprises a further secondary quench exchanger and/or a tertiary quench exchanger, the further secondary quench exchanger and/or the tertiary quench exchanger being provided as the multi-flow heat exchanger.

8. The method according to claim 4, wherein the superheated high pressure steam at the first pressure level and at the first temperature level does not include steam generated from process water and/or only includes steam generated from boiler feed water, such that the superheated high pressure steam at the first pressure level and at the first temperature level is provided as high-purity superheated high pressure steam.

9. The method according to claim 1, wherein the steam cracking arrangement is operated in different operating modes, using differing electric power consumption rates, while maintaining a constant total cracking product yield.

10. The method according to claim 1, wherein at one of the feed stream or a part thereof, the feed hydrocarbons or a part thereof, dilution steam or a part thereof, and boiler feed water or a part thereof is preheated using a saturated or subcooled condensate water stream.

11. The method according to claim 1, wherein the quench cooling train includes a primary quench exchanger and a secondary quench exchanger, wherein the primary quench exchanger performs at least a part of the first one of the cooling steps and the secondary quench exchanger performs at least a part of the second one of the cooling steps or vice versa.

12. The method according to claim 11, further comprising:

providing a steam generation arrangement operated in thermal association with the steam cracking arrangement; and using the steam generation arrangement to produce at least superheated high pressure steam at a first pressure level of 30 and 175 bar absolute pressure and at a first temperature level;

wherein:

no steam at a higher temperature level than the first temperature level is generated;

the superheated high pressure steam at the first pressure level is at least in part adiabatically and is enthalpically expanded to a second pressure level below the first pressure level such that its temperature level is lowered to a second temperature level; and the first temperature level is selected such that the second temperature level is between 5 and 120 K above a dew point of steam at the second pressure level.

13. The method according to claim 11, wherein the steam generation arrangement comprises:

a multi-flow heat exchanger in which heat is transferred from the cracked gas stream to boiler feed water and/or to a steam stream used in forming the superheated high pressure steam; and/or an electric steam superheater.

14. The method according to claim 11, wherein at least a part of the feed hydrocarbons used in forming the feed stream are preheated using at least a part of the cracked gas stream in a multi-flow heat exchanger.

15. The method according to claim 13, wherein the quench cooling train comprises a further secondary quench exchanger and/or a tertiary quench exchanger, the further secondary quench exchanger and/or the tertiary quench exchanger being provided as the multi-flow heat exchanger.

16. The method according to claim 14, wherein the quench cooling train comprises a further secondary quench exchanger and/or a tertiary quench exchanger, the further secondary quench exchanger and/or the tertiary quench exchanger being provided as the multi-flow heat exchanger.

17. The method according to claim 12, wherein the superheated high pressure steam at the first pressure level and at the first temperature level does not include steam generated from process water and/or only includes steam generated from boiler feed water, such that the superheated high pressure steam at the first pressure level and at the first temperature level is provided as high-purity superheated high pressure steam.

18. The method according to claim 1, wherein the steam cracking arrangement comprises a plurality of steam cracking arrangements, at least one steam cracking arrangement of the plurality of steam cracking arrangements being-operated, in different operating modes, using differing electric power consumption rates, while maintaining a constant total cracking product yield.

19. A system for performing a method of steam cracking, comprising:

a steam cracking arrangement, including:

an electric cracking furnace without a convection zone; and a quench cooling train;

wherein:

the system is configured to;

supply at least a part of the feed stream to the electric cracking furnace;

withdraw a cracked gas stream from the electric cracking furnace; and pass at least a part of the cracked gas stream through the quench cooling train;

the quench cooling train comprises means to perform at least two distinct cooling steps, wherein:

a first one of the cooling steps is adapted to cool at least a part of the cracked gas stream against vaporizing boiler feed water at an absolute pressure level between 30 and 175 bar; and a second one of the cooling steps is adapted to cool at least a part of the cracked gas stream withdrawn from the electric cracking furnace against at least a part of the feed stream which is thereby heated to a temperature level between 35° and 750° C.; and the system is further configured to produce saturated steam in at least one of the first one of the cooling steps and the second one of the cooling steps of the quench cooling train, and indirectly heating at least one of the feed stream or a part thereof, the feed hydrocarbons or a part thereof, dilution steam or a part thereof, and boiler feed water or a part thereof using at least a part of the saturated steam, thereby condensing said saturated steam.

* * * * *